US007582402B2

(12) United States Patent
Yamazaki et al.

(10) Patent No.: US 7,582,402 B2
(45) **Date of Patent: *Sep. 1, 2009**

(54) IMAGE FORMING METHOD

(75) Inventors: Hiroshi Yamazaki, Hachioji (JP); Meizo Shirose, Hachioji (JP); Masafumi Uchida, Toyokawa (JP)

(73) Assignee: Konica Minolta Business Technologies, Tokyo (JP)

( * ) Notice: Subject to any disclaimer, the term of this patent is extended or adjusted under 35 U.S.C. 154(b) by 157 days.

This patent is subject to a terminal disclaimer.

(21) Appl. No.: 11/333,436

(22) Filed: Jan. 17, 2006

(65) Prior Publication Data

US 2006/0216631 A1 Sep. 28, 2006

(30) Foreign Application Priority Data

Mar. 24, 2005 (JP) ..... 2005-085093

(51) Int. Cl.
*G03G 15/16* (2006.01)

(52) U.S. Cl. ..... 430/125.3; 430/123.52

(58) Field of Classification Search ..... 430/125.3, 430/123.52

See application file for complete search history.

(56) References Cited

U.S. PATENT DOCUMENTS 5,023,158 A * 6/1991 Tomono et al. ..... 430/124.31
6,310,117 B1 * 10/2001 Sawada et al. ..... 523/200
6,456,820 B1 9/2002 Sato et al.
6,562,529 B1 5/2003 Kojima et al.
6,562,531 B2 5/2003 Niimi
6,656,653 B2 * 12/2003 Mitsuhashi et al. .... 430/108.23
7,022,450 B2 4/2006 Asano et al.
7,220,527 B2 5/2007 Asano et al.
2003/0054269 A1 3/2003 Yamazaki et al.
2004/0063018 A1 * 4/2004 Silence et al. ..... 430/108.4
2005/0208398 A1 * 9/2005 Ohmura et al. ..... 430/111.4
2006/0120773 A1 6/2006 Itami et al.

FOREIGN PATENT DOCUMENTS

JP 2001100546 A * 4/2001
JP 2003241569 8/2003

OTHER PUBLICATIONS

Handbook of Imaging Materials Edited by Arthur S. Diamond, Diamond Research Corporation, Ventura, California, Marcel Dekker, Inc., pp. 160-161.

* cited by examiner

*Primary Examiner*—Christopher RoDee
(74) *Attorney, Agent, or Firm*—Lucas & Mercanti LLP

(57) ABSTRACT

An image forming method, comprising: a step of forming a toner image on a image carrying member; and a step of transferring the toner image from the image carrying member to a transfer member, wherein toner forming the toner image has a volume-basis median diameter of 3.0 to 5.0 μm, contains a releasing agent with a melting point in the range of from 40° C. to 75° C., and is added with a lubricant.

11 Claims, 5 Drawing Sheets

IMAGE FORMING METHOD

BACKGROUND OF THE INVENTION

The present invention relates to an image forming method to form a toner image on a transfer material by toner containing a resin particle and a release agent having melting point in a specific range and by utilizing a supersonic vibration.

RELATED ART

A digital system is presently the main current of image forming of a type of an electrophotographic system, and there is given a full-color image forming technology as one of the trends of that technology. As one of the technologies to promote color toner images, there is in existence the one that forms full-color toner images by using toner containing much release agents without using oil at the time of fixing (for example, refer Patent Document 1). Here, the toner which makes it possible to conduct fixing without using oil may be called as oilless toner.

In the digital image forming, a small dot image on a level of 1200 dpi (the number of dots per 1 inch which is 2.54 cm) is sometimes visualized. Therefore, images are formed by using toner that is in a size of several microns called a small particle size toner.

In image forming by a small particle size toner, there has been a tendency that transferability is worsened when toner images formed on the surface of a photoconductor are transferred onto a transfer material such as a sheet of paper or OHP film. In particular, the tendency is remarkable in full-color image forming to form toner images by superposing Y color toner, M color toner and C color toner, and thus, it has been difficult to transfer toner images from the photoconductor surface or from an intermediate transfer object stably and surely, which has made it difficult to form color images having excellent color balance and density on a transfer material.

Accordingly, there have been studied technologies to transfer toner images surely onto a recording medium by giving physical operations on the photoconductor, and as one means thereof, there is a technology wherein supersonic waves are applied on an image carrier that holds toner images when transferring toner images onto a transfer material, and thereby, toner images are transferred efficiently onto a transfer material from the surface of the image carrier by the actions of vibrations generated from the supersonic waves (for example, refer Patent Document 2 and Patent Document 3).

However, transfer of toner images employing supersonic waves disclosed in Patent Document 2 and Patent Document 3 has been one developed for the toner for which oil is coated on a transfer material in the course of fixing. So, image forming was tried through this transfer method by using oilless toner, in vain. When transfer by means of supersonic waves was tried by using oilless toner, release agents were removed from toner particles by the actions of vibrations coming from the supersonic waves, resulting in the problem that a transfer material wound itself round a fixing roller in the fixing process, and offsetting was caused.

Since externally added agents have also been removed from the oilless toner together with the release agents, toner images were easily disturbed by the influence of vibration by supersonic waves, because of the tendency that force of adhesion to the photoconductor is increased and transfer rate is lowered, thus, it was difficult to superpose each monochromatic toner image correctly on a full-color image.

Patent Document 1:TOKKAI No. 2002-214821 (see Paragraph 0049)

Patent Document 2:TOKKAI No. 2001-100546 (see Paragraph 0022)

Patent Document 3: TOKKAI No. 2001-117381 (see Paragraph 0035)

SUMMARY OF THE INVENTION

An image forming method according to the present invention comprises:

a step of forming a toner image on an image carrying member; and a step of transferring the toner image from the image carrying member to a transfer member applying ultrasonic vibration, wherein toner forming the toner image has a volume-basis median diameter of 3.0 to 5.0 μm, contains a releasing agent with a melting point in the range of from 40° C. to 75° C., and is added with a lubricant.

DETAILED DESCRIPTION OF THE PREFERRED EMBODIMENT

Figure 1:
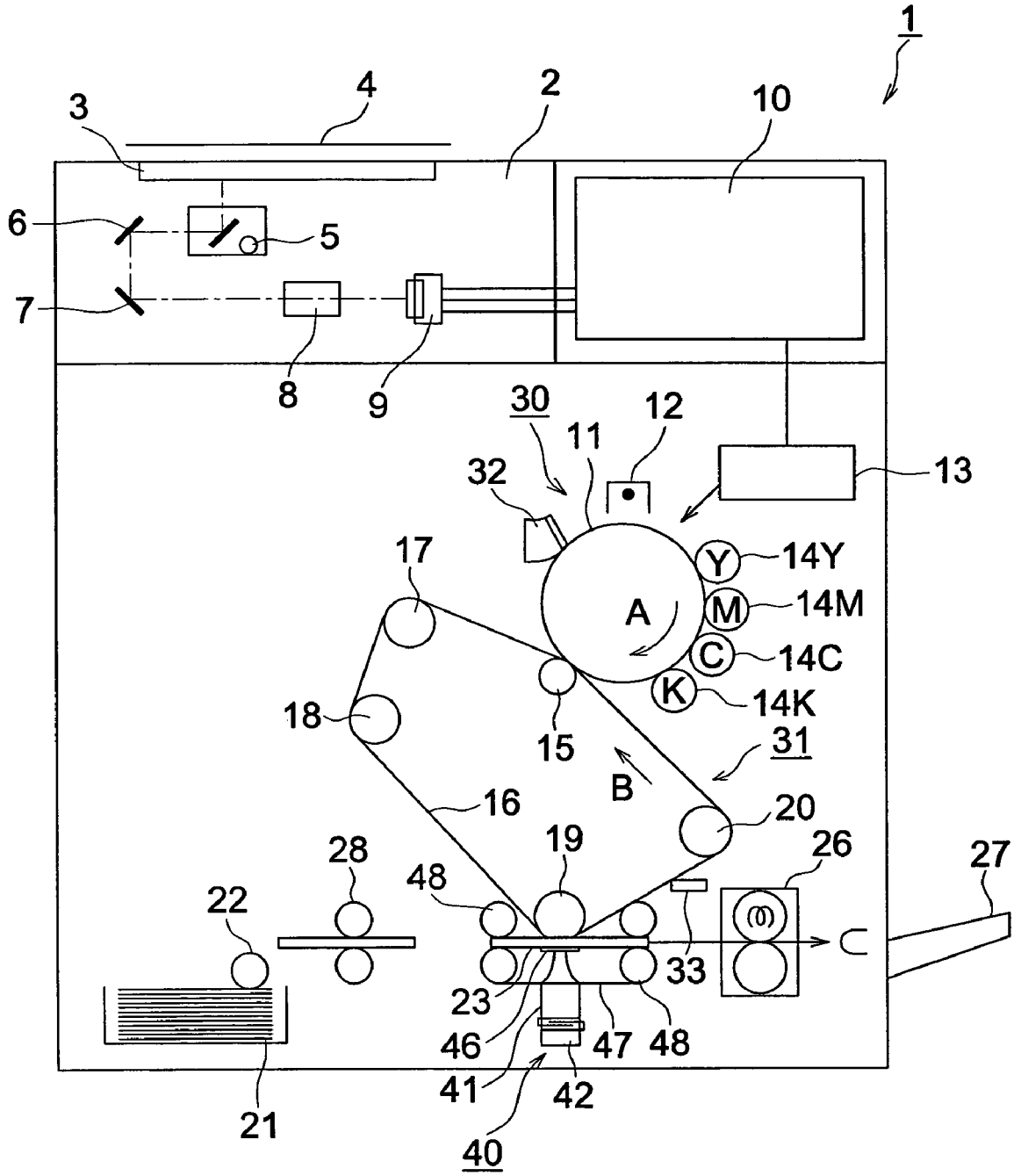
FIG. 1 is a schematic illustration showing an example of image forming apparatus preferably employed in the invention.

An embodiment of the invention has been achieved in view of the problems stated above, there is provided an image forming method having at least a transfer process using supersonic waves, wherein the problem that a transfer material winds itself round a fixing roller, and offsetting is caused, can be prevented by using toner in which release agents are hardly removed from toner particles, for image forming.

Further, according to the present invention, there is provided an image forming method wherein toner images are not disturbed even when they receive vibrations from supersonic waves and a toner image of each color can be superposed correctly on another toner image, and a full-color image having high image quality can be formed.

Inventors presumed that when oilless toner particles received supersonic wave vibrations, a release agent layer in the toner particles was influenced by the vibrations preferentially and selectively in the toner particles, resulting in concentration of the influences of the vibrations by supersonic waves on the release agent layer, which made the release agent layer to be removed from the toner particles.

Based on this presumption, the inventors studied a method to prevent from removal of a release agent layer from toner particles, and found out that removal of a release agent layer from toner particles caused by the influence of supersonic waves can be prevented by in image formation employing oilless toner described below, to form excellent images.

Namely, the present invention relates to an image forming method that uses ultrasonic vibration when developing toner on an image carrier or when transferring a toner image on a transfer material, and the invention has found that problems of the invention are solved by a toner used for the said image forming, wherein the toner contains a releasing agent with a melting point in the range of from 40° C. to 75° C. and a volume-basis median diameter in the range of from 3.0 to 5.0 μm, which is also added with a lubricant.

With the toner having the above described composition, although the toner undergoes vibrations in the image forming process using ultrasonic vibration, the removal of the releasing agent phase does not occur. As a result, such troubles as winding of the transfer material around a fixing roller and offset that have occurred due to the removal of the toner from the releasing agent are solved, so that stable image forming can be carried out.

Further, the toner is not influenced by vibrations in image forming, so that the problem of image turbulence can be solved. As a result, a better full-color toner image on which the toner images of different colors are correctly superimposed can be constantly obtained.

The reason why the above advantages of the invention are expressed can be supposed as follows. That is, in the invention, because the lubricant and the releasing agent each have a higher fatty acid composition, an appropriate affinity is supposed to occur between the two due to their similar compositions. It is further supposed that the affinity works between them to allow the lubricant to prevent the releasing agent from removing, even when a substantial load is applied to the toner and the releasing agent is likely to remove from the toner.

First of all, the toner used in the image forming method according to the present invention will be described.

(Description About the Releasing Agent)

The toner used in the image forming method according to the present invention contains a releasing agent with a melting point in the range of from 40° C. to 75° C. In other words, it has been confirmed that, by using the toner having been contained with the releasing agent with a melting point in the range of from 40° C. to 75° C., a stable image forming capability is expressed in the image forming apparatus having the transfer process using ultrasonic vibration.

The stable image forming could be carried out by using the toner containing the releasing agent with a melting point in the range of from 40° C. to 75° C., and the reason for the above fact is supposed as follows. That is, a strong adhesive action is supposed to have been expressed in the phase boundary between the resin component and releasing agent component both forming the toner, due to the releasing agent. As a result, it is supposed that, although the influence caused by the ultrasonic vibration propagated to the toner, the releasing agent did not remove from the toner, and thereby the stable image forming could be carried out.

It has been confirmed that particularly preferable, as the releasing agents expressing such an action advantage, and having a melting point in the above range, are a monovalent alcohol ester compound and distearyl sebacinate of fatty acids such as behenyl behenate, stearyl stearate, and myristyl myristate.

In order to meet the recent demand for oil-less fixing, it is also allowable to use the following releasing agents together with the above releasing agents according to the necessity. In other words, by omitting the use of the stripping auxiliary agent such as silicone oil applied to a surface of the fixing member, it is possible to reduce gloss irregularities caused by the move of the stripping auxiliary agent to the fixing base material (paper). Further, this allows to simplify the configuration of the fixing device itself, which is effective for the size reduction of the fixing device.

More specifically, the releasing agents include the followings: low-molecular-weight polyolefins such as polyethylene, polypropylene, and polybutene; silicones showing softening point by heating; fatty acid amides such as amide oleate, amide erucate, amide ricinoleate, and amide stearate; plant waxes such as carnauba wax, rice wax, canderilla wax, haze wax, and jojoba oil; animal waxes such as beeswax; mineral or petroleum waxes such as montan wax, ozokerite, ceresin, paraffin wax, microcrystalline wax, and Fischer-Tropsch wax; ester waxes of higher fatty acid and higher alcohol such as stearyl stearate, behenyl behenate, and myristyl myristate; ester waxes of higher fatty acid and monovalent or polyvalent lower alcohol such as butyl stearate, glyceride monostearate, glyceride distearate, and pentaerythritol tetrabehenate; ester waxes composed of higher fatty acid and polyvalent alcohol multimer such as diethyleneglycol monostearate, dipropylene glycol distearate, diglyceride distearate, and triglyceride tetrastearate; sorbitan higher fatty acid ester wax such as sorbitan monostearate; and cholesterol higher fatty acid ester wax such as cholesteryl stearate.

The addition amount of the releasing agent to the toner used in the image forming method according to the invention is appropriate in the range of from 0.5 to 50% by mass relative to the toner. Preferably, it is appropriate in the range of from 1 to 30% by mass, more preferably, in the range of from 5 to 15% by mass. Setting, the addition amount of the releasing agent in the range as described above allows to express a better releasing capability, as well as to express a stable image forming capability in the image forming apparatus having the transfer process using ultrasonic vibration.

The toner used in the invention has a volume-basis median diameter of from 3.0 to 5.0 μm, and preferably, of from 3.5 to 4.0 μm. Herein, the volume-basis median diameter is that shows the particle diameter at 50% accumulation in the particle diameter distribution on a volume basis (50% diameter). The volume-basis median diameter of the toner can be controlled depending on the coagulant (electrolyte agent) concentration, input timing, or temperature.

In the present invention, by adjusting the volume-basis median diameter of the toner used in the image forming method having the transfer process using ultrasonic vibration in the range of from 3.0 to 5.0 μm, preferably of from 3.5 to 4.5 μm, it has been confirmed that in addition to the above described problems, the thin line reproducibility and the dot image are substantially improved, and that the toner is applicable to forming a digital image of 1200 dpi level.

Further, a specific example of the measuring equipment for the volume-basis median diameter of the toner includes SALD-1100 (manufactured by Shimadzu Co., Ltd.). It can be also measured using COULTER COUNTER TA-II or COULTER MULTISIZER (both manufactured by Beckman Coulter Co., Ltd.). In the present invention, the volume-basis median diameter of the toner was measured and calculated using SALD-1100, an interface (manufactured by Nikkaki Co., Ltd.) for outputting the particle distribution and a personal computer, and connecting them with each other.

A concrete measuring means for a volume-based median diameter measures and calculates by using an apparatus which connects a computer systems for processing data (manufactured by Beckmann coulter) to COULTER MULTISIZER III (manufactured by Beckmann coulter).

As a measuring procedure, after familiarizing 0.02 g of toner with 20 ml of a surfactant solution (surfactant solution in which for example, a neutral detergent containing a surfactant composition was diluted in ten times with pure water for the purpose of dispersing toner), ultrasonic homogenization was performed for one minutes, whereby a toner dispersion liquid was prepared. This toner dispersion liquid was poured with a pipet into a beaker containing ISOTON II (manufactured by Beckmann coulter) in a sample stand until instrument display a concentration indicated by a measuring device became 5%-10%. By making the concentration within this concentration range, a reproducible measured value can be acquired. In the measuring device, a measuring particle count number is set to 25000 pieces and an aperture diameter is set to 50 micrometers, and a measuring range of a range of 1-30 micrometers is divided into 256 and frequency values are calculated. A particle diameter of 50% from a large side of a volume addition percentage is made as a volume-based median diameter.

(Description About the Lubricant)

The toner used in the image forming method according to the present invention is added with a lubricant as external additive particles. The lubricant referred herein is used for promoting the smoothness between a cleaning member and an image carrier such as a photoreceptor to reduce the friction therebetween.

Used herein as the lubricant component is at least one type selected from the group consisting of higher fatty acid, higher fatty acid amide, higher fatty acid ester and higher fatty acid metal salt. The higher fatty acid used herein may include fatty acids each having a carbon number of approximately 16 or more, preferably of from 16 to 30, and more specifically, such as palmitic acid, stearic acid, oleic acid, linoleic acid, arachidic acid, and behenic acid.

Further, the higher fatty acid metal salt used herein may include metal salts of fatty acids each having a carbon number of approximately 12 or more, preferably of from 12 to 30, such as zinc, magnesium, calcium, barium, and aluminum. Specific examples of the compound include the followings: lauric acid metal salts such as zinc laurate and calcium laurate; myristic acid metal salts such as zinc myristate and calcium myristate; and stearic acid metal salts such as zinc stearate, aluminum stearate, and magnesium stearate. Particularly, the stearic acid metal salt is low in price, and significantly promotes the smoothness between the cleaning member and the image carrier for which the reason may be that the stearic acid metal salt has the structure in which the group having a hydrophobic property and the part expressing a hydrophilic property coexist.

Further, it has been confirmed that a better cleaning capability is expressed with a moisture content of the higher fatty acid metal salt set in the range of from 0.1 to 2.5% by mass and a free fatty acid content thereof set in the range of from 0.01 to 0.7% by mass, although it is not clear how the residual moisture and free fatty acid component within the lubricant specifically work.

Moisture content measurement can be carried out by the following method. That is, it can be carried out by Carl Fischer coulometric-titration method (Karl Fischer Coulometric titration method). Concretely, an automatic heat vaporization moisture measuring system AQS-724 (made by HIRANUMA SANGYO Co., Ltd.) which consists of a moisture meter (AQUACOUNTER) AQ-6, AQI-601 (an interface for AQ-6) and a heating vaporizing apparatus (AUTOMATED SOLID EVAPORATOR) LE-24S is used. 0.5 g of a lubricant left alone in an environment of 20 degrees C./50% RH for 24 hours is precisely measured and is put in a 20 ml glass sample tube, subsequently, the tube is capped closely with a silicone rubber packing of a Teflon coat. In order to rectify a water content which exists in the environment which is enclosed with the cap, two empty samples are measured simultaneously. A measurement condition and agents are as follows.

Sample heating temperature: 110 degrees C.

Sample heating time: 1 minute

Nitrogen-gas flow quantity: 150 ml/minutes

Agents: HYDRANAL®-Coulomat CG-K It and HYDRANAL®-Coulomat AK

Further, when assuming that the sum of the toner and the lubricant is 100% by mass, the addition amount of the lubricant is preferably set equal to or more than 0.3% by weigh and equal to or less than 10% by mass.

Next, the image forming apparatus used in the present invention will be described. According to the present invention, the image forming apparatus carries out a full color image forming by transferring the toner images with adding the ultrasonic vibration thereto, when transferring the toner image formed on the image carrier onto the transfer material such as paper, or when transferring the toner images formed on the image carriers onto the intermediate transfer body, or further when transferring the superimposed toner images on the intermediate transfer body onto the transfer material.

FIG. 1 is a schematic illustration showing an example of image forming apparatus preferably employed. The image forming apparatus has a drum-shaped photoreceptor 11 rotatable in the direction of arrow A as an image carrier, and an original reading section 2 to read the image of original 4 is arranged at the upper portion of the body of the color forming apparatus 1. The image reading section has a platen glass 3, a light source 5, two scanning mirrors 6 and 7, a focusing lens 8 and a color CCD sensor 9.

In the body of the color image forming apparatus 1, an image forming unit 30, an intermediate transferring member unit 31 are arranged. In the image forming unit 30, a charging device 12 for almost uniformly charging the photoreceptor drum 11, a laser beam scanning device for writing a static latent image by irradiating a laser beam to the photoreceptor drum 11, and developing devices 14Y, 14M, 14C and 14K each containing a Yellow (Y), magenta (M), cyan (C) and black (Bk) toners, respectively, are arranged around the photoreceptor drum 11.

In the intermediate transfer unit, an intermediate transfer belt 16 is provided which is suspended by a first transferring backup roller 15, a driving roller 17, idling rollers 18 and 20, and a secondary transferring backup roller 19, and the intermediate transfer belt 16 is driven by a driving roller 17 so as to be circulated in the direction of arrow B.

At the lower portion of the body of the image forming apparatus 1, a paper supplying cassette containing paper 23, a conveying roller 22 for picking up and conveying the paper 23 one by one, and a register roller 28 for conveying the paper 23 to the position facing to the intermediate transfer belt 16, are provided.

Then, an ultrasonic wave generation element 42 and a horn 41 are arranged at the portion where the intermediate transfer belt 16 is faced to the image receiving material, and they are arranged at the back side of the intermediate transfer belt.

Moreover, a fixing device 26 for fixing the toner image transferred onto the paper and a tray 27 onto which the paper after fixing is output are provided.

Figure 4:
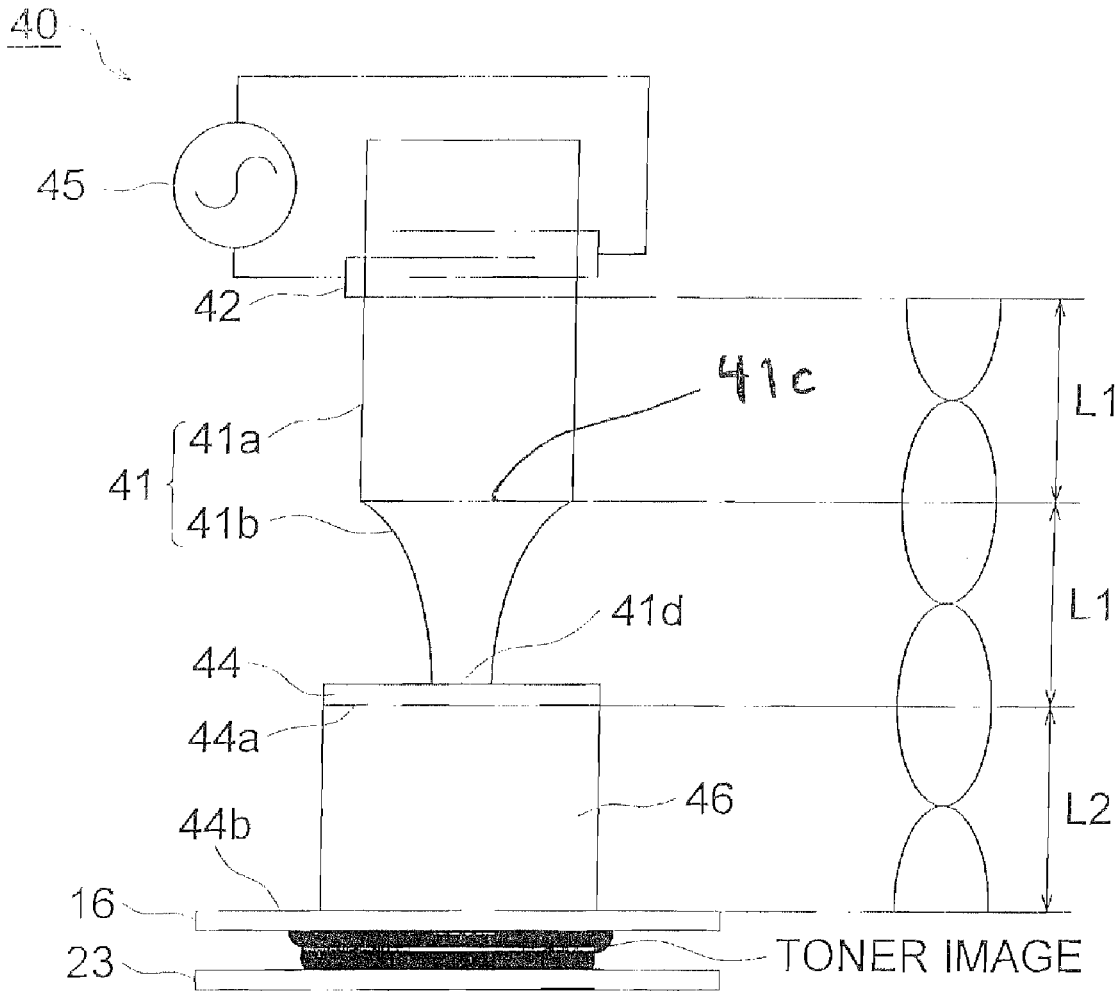
FIG. 4 is a schematic illustration showing an example of ultrasonic radiation device in the invention.

The ultrasonic wave device usable is explained. FIG. 4 is a schematic illustration of a typical ultrasonic wave apparatus 40 employable in the invention. The ultrasonic wave apparatus 40 shown in FIG. 4 is constituted by an ultrasonic wave generation element 42, a horn 41 for introducing the generated ultrasonic waves to an ultrasonic wave irradiating face 44*a*, and a high frequency power source 45.

The ultrasonic apparatus is not limited to it. As the ultrasonic wave generation element 42 shown in FIG. 4, for example, a ceramic type piezoelectric element is employed for generating strong ultrasonic waves. The ultrasonic wave generation element 42 is strongly fixed by an organic adhering agent to a straight pipe portion 41*a* of the horn 41 composed of the strait pipe portion 41*a* and a horn portion 41*b*, each of which has a length L. The length L is integer times of ½ of the sonic wavelength of L1 defined by the resonance frequency of the ultrasonic wave generation element and the sonic speed in the material.

The horn portion 41*b* is formed as a bugle-like shape in which the cross section area thereof is made so as to be gradually smaller toward from the straight pipe portion 41*a* contacted with the ultrasonic generation element 42 to the end of the horn portion 41*b*. The material constituting the horn 41 is typically SUS, and aluminum bronze, phosphor bronze, a titanium alloy and duralumin are usable other than USU.

The vibration amplitude of the ultrasonic wave generation element 42 can be amplified corresponding to the ratio of the area of the irradiating face 41*c* of the straight pipe portion 41*a* to the area of the end face 41*d* so that further strong ultrasonic waves can be irradiated. Moreover, the fatigue or the degradation of the vibrating property caused by the vibration stress can be prevented by decreasing the vibration amplitude of the ultrasonic wave generation element 42.

In this example, the ratio of the area of the irradiation end 41*c* of the horn 41 to the area of the end face are 5:1; it has been confirmed that the vibration efficiency of the horn 41 is most effectively realized when the area ratio is near such the ratio.

Moreover, in the ultrasonic apparatus 40, an ultrasonic irradiating plate 44 is attached. In FIG. 4, the ultrasonic irradiation plate has a disc shape having a diameter of 25 cm. An ultrasonic wave irradiating face 44*a* is formed at the face of the ultrasonic irradiation plate facing to the subject.

As above-mentioned, it is made possible by the ultrasonic wave apparatus 40 that the ultrasonic waves are generated by the ultrasonic wave generation element 42 and the vibration amplitude of the ultrasonic waves is amplified by the use of the horn 41 and irradiated from the ultrasonic wave irradiation face 44*a* having a large area so that strong energy vibration is given to a wide area of the subject.

In the example, thus constituted ultrasonic wave apparatus 40 are arranged as a strait line or a staggered line in the cross direction of the intermediate transfer belt 16 to form the ultrasonic wave vibrations applying means.

It is confirmed that a frequency of from 40 kHz to 2 MHz is suitable. The frequency within such the range is preferred since the thickness of the ultrasonic wave generation element has to be thin and the output of the ultrasonic waves is difficultly made large when the frequency is made high. Moreover, in the present invention, in the image formation which conducts transferring with a frequency in the above-mentioned range, It is confirming that by using small size toner which is formed by coagulating resin particles containing a release agent which has a melting point in a range of 40-75 degrees C. and has a form near a globular and a Dp50 of 3.0-5.0 micrometers in volume-basis median diameter, a desirable image formation can be performed especially.

Figure 5:
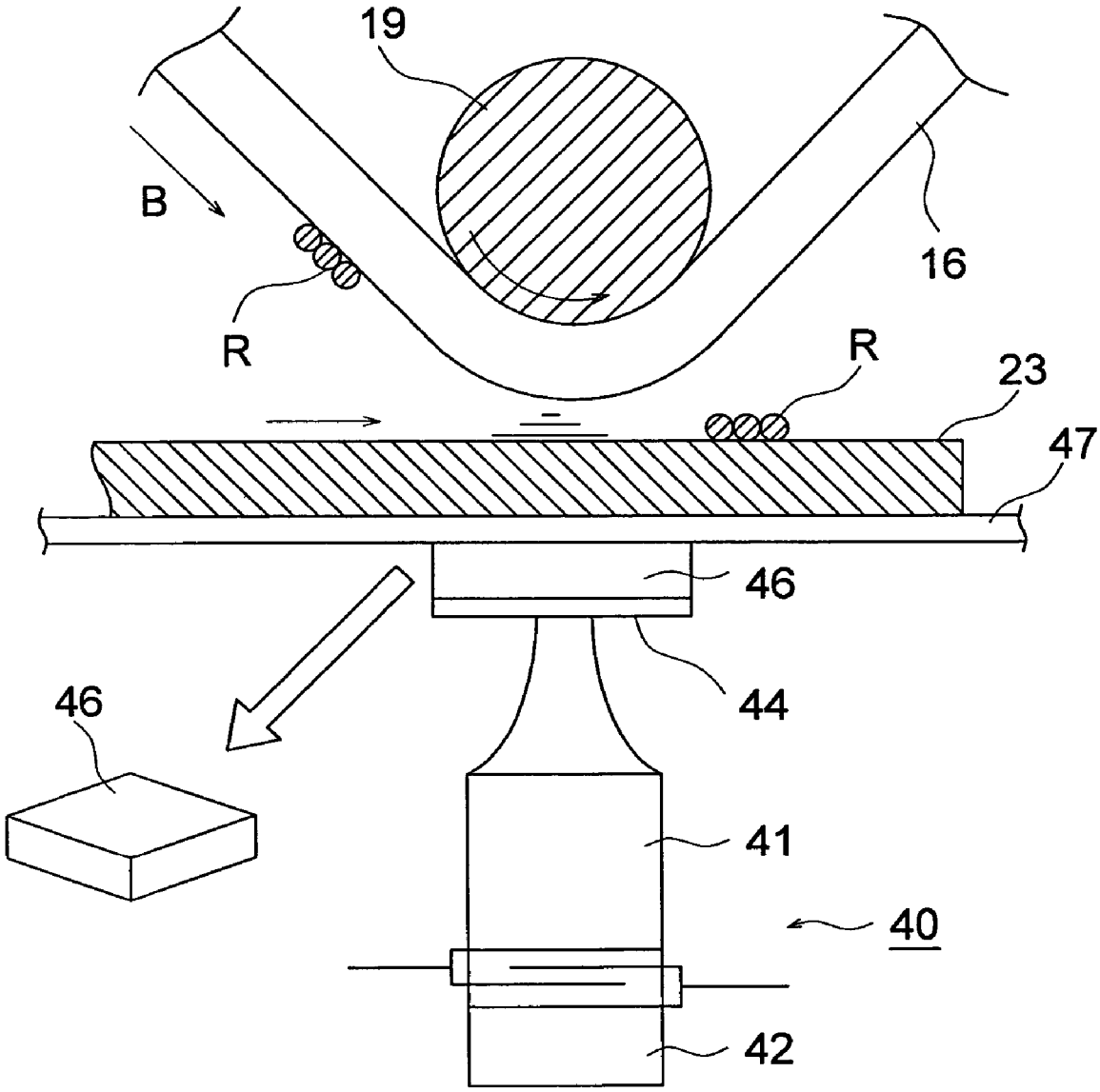
FIG. 5 is a schematic illustration showing transferring position of the intermediate transfer belt and an image receiving material (transfer material).

It is preferable to provide a sheet-shaped gel member 46 as an ultrasonic wave conducting member as shown in FIGS. 4 and 5 between the intermediate transfer belt 16 or the conveying belt 47 and the ultrasonic irradiation face for obtaining high transfer efficiency at the transferring position. Other than the sheet shaped gel member, the gel member 46 may be a formed by coating a gel material take out from a tube on the ultrasonic wave irradiation plate 44.

The ultrasonic waves can be certainly conducted to the intermediate transfer belt 16, so as to raise the transfer efficiency at the transferring position by providing the ultrasonic wave conductive member at the transferring position. Moreover, the ultrasonic wave conductive member prevents rubbing the end portion of the ultrasonic wave apparatus 40 with the intermediate transfer belt 16 or the conveying belt 47 so that the members constituting the apparatus can be protected.

As the gel member 46, for example, 100% silicone is employed and functioned as the ultrasonic wave conducting member on the occasion of the transfer. The gel member 46 most preferable is a sheet-shaped silicone type gel. The sheet-shaped silicone gel is preferable since the sheet-shaped gel can conduct the ultrasonic waves to the facing face 44 while the gel itself is almost not received the influence of pressure.

The silicone type gel is superior in the resistivity to heat and chemicals, and the properties thereof are almost not varied accompanied with the passing of time. Therefore, the silicone type gel can stably hold the ultrasonic wave conducting ability for long period and do not contaminate the environment, and it is confirmed that the silicone gel is superior in hygienic and environmental suitability. Concrete examples of the sheet-shaped silicone type gel include a silicone gel sheet composed of a silicone gel layer laminated on a silicone rubber layer, cf. Japanese Patent O.P.I. Publication No. 2-196453, a silicone gel sheet composed of a silicone gel layer laminated on a silicon rubber sheet which is composed of a mesh-shaped reinforcing material such as glass cloth covered with hardened silicone rubber, cf. Japanese Patent O.P.I. Publication No. 6-155517, and a silicone gel sheet having a metal foil on one side thereof, cf. 6-201226. Any types of silicone gel sheet can be employed.

Figure 2:
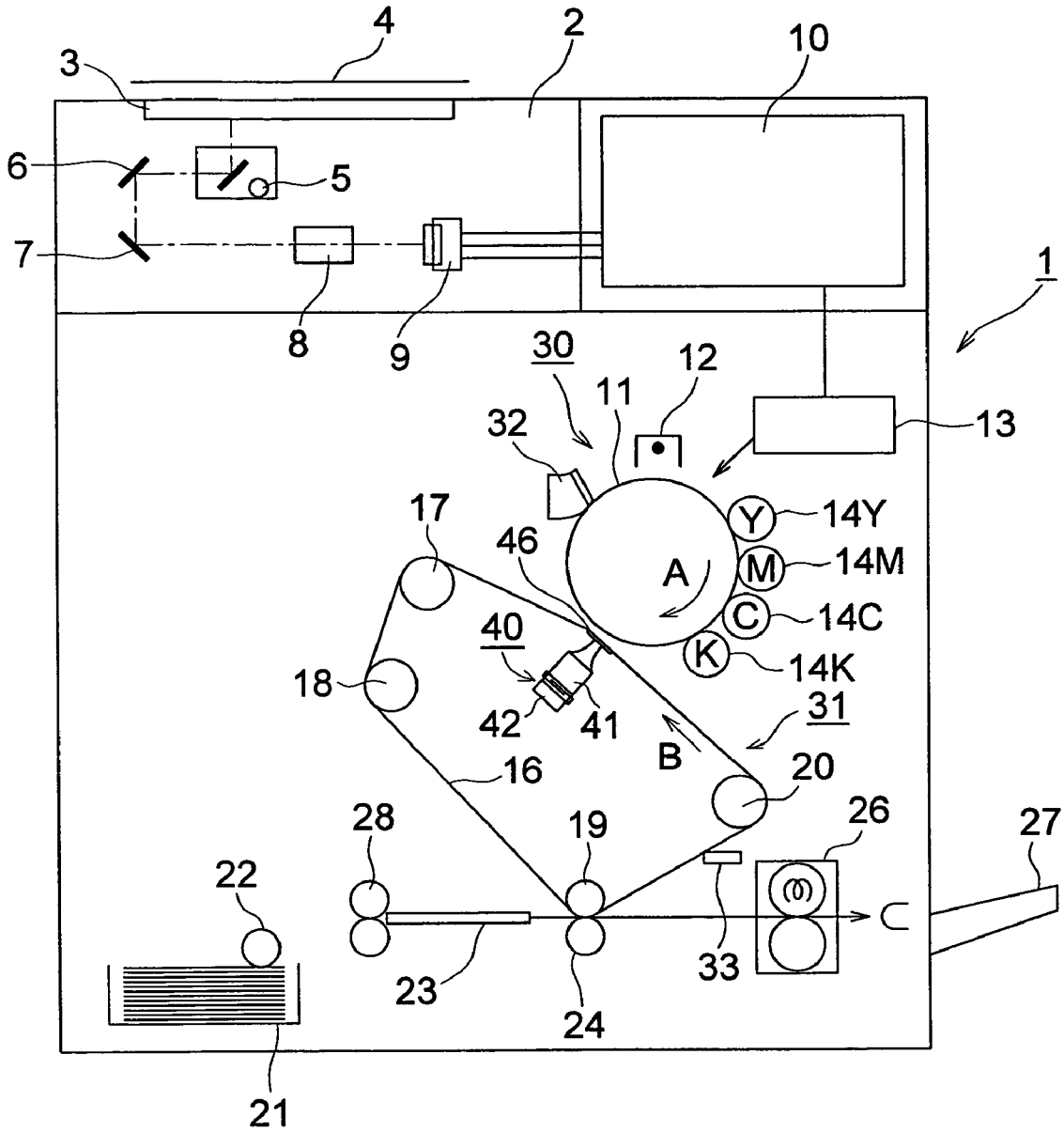
FIG. 2 is a schematic illustration showing an example of the image forming apparatus in which toner image on a photoreceptor drum is transferred to an intermediate transfer member.
Figure 3:
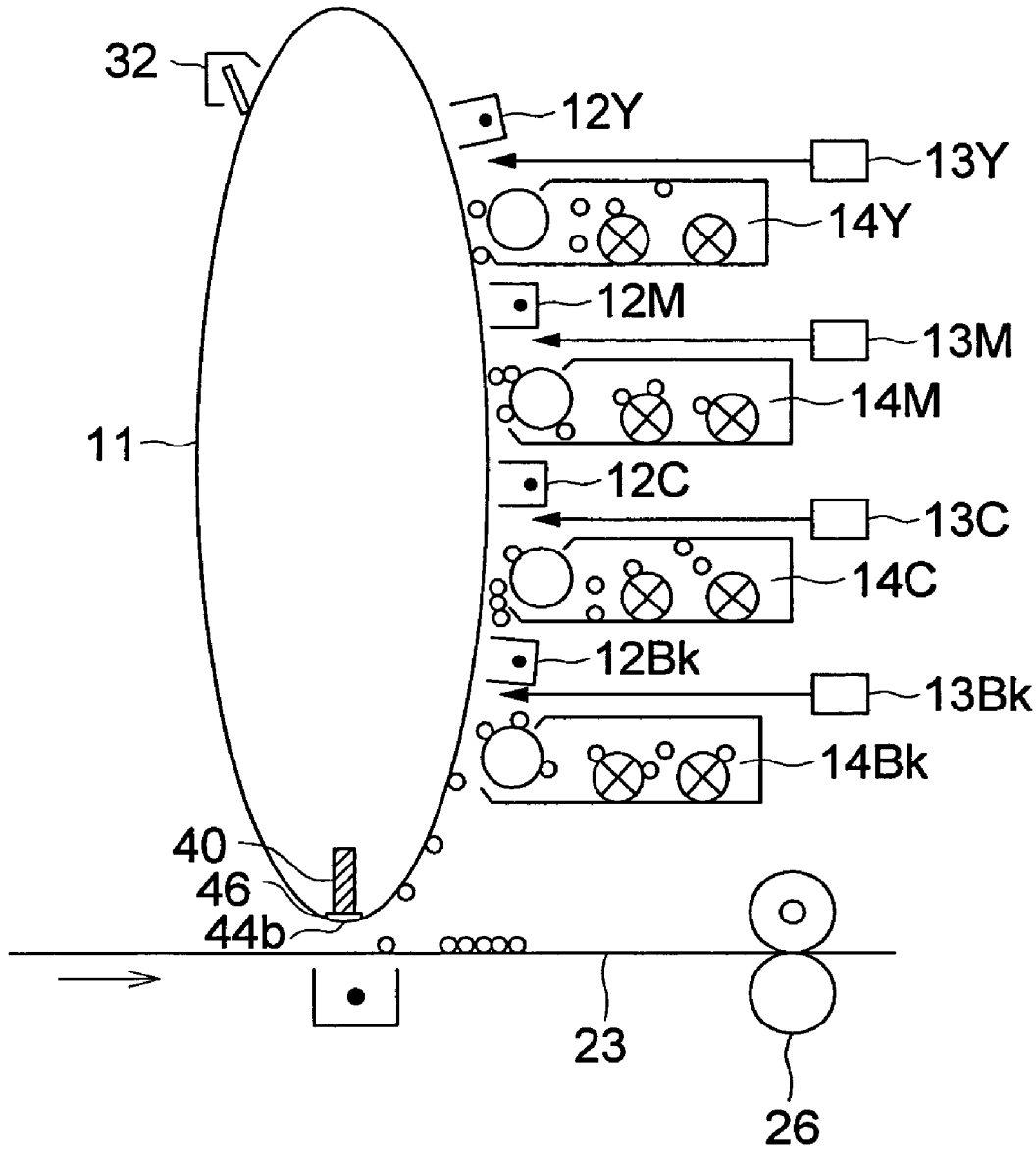
FIG. 3 is a schematic illustration showing another example of image forming apparatus employable in the invention.

In the image forming apparatus shown in FIGS. 1 to 3, the ultrasonic irradiation face 44*a* of the ultrasonic apparatus 40 is faced in parallel to the intermediate transfer belt 16 or the photoreceptor and the image receiving material 23 so that toner image is between them at the transferring position. When the portion of the intermediate transfer belt 16 facing to the ultrasonic irradiation face 44*a* is defined as face 44*b*, the distance L2 between the ultrasonic wave irradiation face 44*a* and the face 44*b* facing to the face 44*a* is set so that the L2 is corresponded to an integer times of ½ of the wavelength L2 of the ultrasonic waves irradiated from the ultrasonic wave irradiation face 44*a*. The distance L2 between the ultrasonic wave irradiation face 44*a* and the face 44*b* is preferred since the highest sensitivity can be obtained when the L2 is ½ of the wavelength 12.

It is supposed that such the phenomenon is caused by formation of a standing wave between the ultrasonic irradiation face 44*a* of the ultrasonic wave apparatus 40 and the facing face 44*b* by agreement of the phase of the ultrasonic waves irradiated from the ultrasonic irradiation face 44*a* of the ultrasonic wave apparatus 40 and that of the ultrasonic waves reflected by the facing face 44*b*.

When the standing wave is formed, force larger than that the simple irradiation of ultrasonic waves affects to the face 44*a* positioned at the antinode portion of the vibration of the standing wave. For example, when an ultrasonic wave generation element 42 having a resonance frequency of 40 kHz, the wavelength 12 of the irradiated ultrasonic waves is approximately 17 mm even though which is influenced a little by the atmosphere temperature because the value of the 12 is the quotient of the sonic speed in air by the resonance frequency.

In FIG. 1, image of light reflected by the original placed on the platen glass 3 and lighted by the light source 5 is read by CCD sensor 9 through the two scanning mirrors 6 and 7 and the focusing lens 8 as image signals of B (blue), G (green) and R (red). The read B, G and R signals are input into an image signal processing means 10 and converted to YMCK (yellow, magenta, cyan and black) signals and temporarily stored in a memory provided in the image signal processing means 10 according to necessity.

The photoreceptor drum 11 is uniformly charged at the designated potential by a charging device 12 and a static latent image is formed by a laser beam scanning means 13. The laser beam scanning means 13 scans the photoreceptor drum 11 by the laser beam according to the image data of each colors of yellow, magenta, cyan and black successively output from the image signal processing means 10, to perform imagewise exposure. Thus the static latent images are formed on the photoreceptor drum 11.

The static latent images formed on the photoreceptor drum 11 are each developed by the developing device 14Y, 14M, 14C and 14K to form yellow, magenta, cyan and black colored images, respectively. The toners of each color are negatively charged and adhered on the area exposed to the laser beam of the photoreceptor drum. One color of image is formed by one rotation of the photoreceptor drum 11, and four colored images are formed by four round of the drum.

The one color image formed by one rotation of the drum is transferred onto the intermediated transfer belt 16 on each time, and the four colored images are piled on the intermediate transfer belt 16 by repeating such the process for four times.

After transference of the four color images onto the intermediate transfer belt 16, the intermediate transfer belt is further circulated and the four color toner images are arrived at the position where the toner images are transferred to the image receiving material. The paper 23 contained in the paper supplying cassette 21 is conveyed by the conveying roller 22 synchronizing with the arrival of the piled toner images to the transferring position and further conveyed by the register roller 28 to the position of transfer from the intermediate transfer belt 16 to the image receiving material.

At the position of transfer from the intermediate transfer belt 16 to the image receiving material, the toner images on the intermediate transfer belt 16 are transferred onto the image receiving material by the ultrasonic wave generation element 42 and the horn 41.

FIG. 5 is a schematic illustration showing the transferring position of the intermediate transfer belt 16 and the image receiving material. At the transferring position where the intermediate transfer belt 16 and the image receiving material or paper 23 are faced to each other, the ultrasonic wave generation element 42 and the horn 41 are provided on back side of the paper 23. As is shown in FIG. 5, the end portion of the horn 41 is vibrated in the same phase (piston vibration) in the direction of the arrow and the standing wave is formed between the intermediate transfer belt 16 and the paper 23 around the horn.

To contribute with high efficiency the ultrasonic waves generated by the driving of the ultrasonic wave generation element 42 to the transfer, it is preferable that the paper 23 is strained by sufficient force so as to occur the ultrasonic vibration at the surface of the paper.

At the upper stream side and the lower stream side of the transferring position, pare of rollers 48 are arranged and a conveying belt 47 is provided between them to apply the strain force to the paper 23.

A power source, not shown in the drawing, may be attached to the rollers 48 and the conveying belt 47 for applying voltage in the direction so that the toner particles are not adhered.

As above-mentioned, the toner images piled on the intermediate transfer belt 16 is transferred onto the paper 23 at the transferring position by the ultrasonic waves.

A means utilizing static electricity force or heat for increasing the holding ability of the tone image may be provided to prevent the deformation if the image caused by the rebounding of the toner particle R or the use of paper having small mirror force generated by itself.

In concrete, a means in which a power source is connected to the horn 41 to apply voltage for holding the toner particle R, and a means in which a transferring roller capable of being applied voltage is touched to the back side of the paper 23 are employable. By such the means, charge is given to the paper 23 as to hold the toner particle R on the paper 23. A tension roller may be provided on the opposite side, through the horn 41, of the transfer holding roller may be arranged to prevent the slacking vibration of the paper 23.

The paper on which the toner image is transferred, is fixed by heating and pressure by the fixing device 26 and output on the tray 27, thus a series of color image forming cycle is completed.

On the other hand, the photoreceptor drum 11 after finishing of the image transfer to the intermediate transfer belt 16 is introduced to the next image forming cycle after removing of the toner remained on the surface by cleaning device 32. The intermediate transfer belt 16 after finishing of the image transfer to the paper 23 is introduced to next image forming cycle after removing of the toner remained on the surface of the intermediate transfer belt 16 by cleaning device 33.

As above-described, it is possible in the image forming apparatus employed in the invention to fly the toner particle for transferring by utilizing the sonic irradiation force of the ultrasonic standing wave on the occasion of transfer the toner image on the intermediate transfer belt to the image receiving material (paper 23), and the destroying of the toner particle caused by the releasing the particle of the parting agent is avoided by the use of the toner in which the parting agent is dispersed in the specified state so that the occurrence of deformation of image at the time of transfer can be prevented.

The invention can be also applied to the process in which the ultrasonic vibration is applied for transfer the toner image formed on the photoreceptor to the intermediate transfer belt 16 other than the process for transferring the toner image on the intermediate transfer belt 16 to the image receiving material. FIG. 2 is a schematic illustration showing an example of the image forming apparatus in which the toner image on the photoreceptor drum is transferred onto the intermediate transfer belt by the ultrasonic waves transfer method. It is also preferred in FIG. 2 that the gel member 46 is employed as the ultrasonic wave conductive means between the intermediate transfer belt and the ultrasonic apparatus 40 even though the gel member is not displayed in the drawing.

FIG. 3 is a schematic illustration of another full color image forming apparatus employable in the invention. In the image forming apparatus of FIG. 3, the full color toner image formed on the photoreceptor 11 is transferred onto the image receiving material.

In the image forming apparatus of FIG. 3, a unit image of yellow is firstly formed on the belt-shaped photoreceptor. The procedure is the same as that in the formation apparatus for the monocolor image; firstly the surface of the photoreceptor is uniformly charged by the charging device, the photoreceptor surface is imagewise exposed by the image exposure device and developed by the yellow color toner to form the yellow image.

A magenta, cyan and black images are formed on the same area of the photoreceptor by synchronized timing with the rotation of the photoreceptor 11.

When the photoreceptor 11 is arrived, by the continuation of the moving thereof, at the position of the ultrasonic apparatus corresponding to the facing face 44*b*, the full color toner image is transferred onto the image receiving material 23 conveyed by adjusted timing. The image receiving material 23 carrying the full color toner image is conveyed into the fixing device 26 and the color image is fixed on the image receiving material 23.

It is also preferable in FIG. 3 that the gel member 46 is provided as the ultrasonic wave conducting member between the facing face 44*b* and the ultrasonic apparatus 40.

The photoreceptor 11 is further continuously rotated after transfer of the toner image, and the remained toner and paper powder on the surface of the photoreceptor are removed by the cleaning device 32 having a blade and then the photoreceptor is reused for next image formation.

The production method of the toner will now be described.

Although production methods of the toner are not particularly limited, an associating method make particles associate in water base media especially is desirable.

As the associating method, a method of coagulating and fusing at least resin particles containing a releasing agent and coloring particles in water base media and a method of coagulating and fusing at least resin particles, a releasing agent and coloring particles in water base media may be employed.

In the present invention, the former is described as a manufacturing process 1 and the latter is described as a manufacturing process 2.

As for the resin particles used in the associating method, it is desirable to use resin particles adjusted by an emulsion polymerization method.

Moreover, as for the resin particles containing the releasing agent used in the manufacturing process 1, the resin particles containing the releasing agent can be adjusted by dissolving and dispersing a releasing agent in a vinyl base monomer, and by polymerizing them in water base media when adjusting resin particles.

In the manufacturing process 2, the resin particles may be adjusted from a vinyl base monomer without containing a releasing agent.

Listed as materials used for minute resinous particles, for example, thermoplastic resins. Specific examples include homopolymers or copolymers (styrene based resins) of styrene such as styrene, para-chlorostyrene, or α-methylstyrene; homopolymers or copolymers (vinyl based resins) of esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, or 2-ethylhexyl methacrylate; homopolymers or copolymers (vinyl based resins) of vinylnitrile such as acrylonitrile or methacrylonitrile; homopolymers or copolymers (vinyl based resins) of vinyl ethers such as vinyl methyl ether or vinyl isobutyl ether; homopolymers or copolymers (vinyl based resins) of vinyl methyl ketone, vinyl ethyl ketone, or vinyl isopropenyl ketone; homopolymers or copolymers (olefin based resins) of olefins such as ethylene, propylene, butadiene, or isoprene; non-vinyl condensation based resins such as epoxy resins, polyester resins, polyurethane resins, polyamide resins, cellulose resins, or polyether resins, and graft polymers of these non-vinyl condensation resins with vinyl based monomers.

Of these resins, the vinyl based resins are most preferable. Vinyl based resins exhibit advantages such that by performing polymerization employing compounds such as ionic surface active agents, it is possible to readily prepare a minute resinous particle dispersion. Listed as above vinyl based monomers are those such as acrylic acid, methacrylic acid, maleic acid, cinnamic acid, fumaric acid, vinylsulfonic acid, ethyleneimine, vinylpyridine, or vinylamine, which are employed as a raw material to prepare vinyl based polymer acids or a vinyl based polymer acid salts. Of these vinyl based monomers, in view of ease of vinyl based resin forming reaction, the vinyl based polymer acid is more preferred. Specifically most preferred are dissociative vinyl based monomers having, as a dissociation group, a carboxyl group, such as acrylic acid, methacrylic acid, maleic acid, cinnamic acid, or fumaric acid in terms of degree of polymerization and the control of the glass transition point.

Incidentally, it is possible to determine the concentration of the dissociation group in the above associative vinyl based monomers, employing a quantitative analytical method in which particles, such as toner particles, are dissolved from the surface, described, for example, in "Kobunshi Latex no Kagaku (Chemistry of Polymer Latexes)" (Kobunshi Kanko Kai). Further, employing the above method, it is possible to determine the molecular weight and the glass transition point from the surface to the interior of a particle.

The average particle diameter of minute resinous particles is commonly at most 1 μm, but is preferably in the range of 0.01-1 μm. By adjusting the average particle diameter to at most 1 μm, it has been confirmed that the particle size distribution of the finally obtainable electrostatic image developing toner narrows, and at the same time, and performance and reliability of the toner are enhanced due to the retardation of generation of liberated particles. Further, by controlling the average particle diameter of minute resinous particles within the above range, deviation among toner particles is decreased and fluctuations of performance and reliability of the toner is advantageously reduced. Incidentally, the above average particle diameter is a mean volume diameter (D4) measured by MICROTRAC UPA (made by HONEYWELL).

In the toner production method, a colorant dispersed dispersion is employed. Listed as colorants which are employed for the above operation are, for example, various pigments such as carbon black, chrome yellow, Hansa yellow, benzidine yellow, Surene Yellow, quinoline yellow, permanent orange GTR, pyrazolone orange, vulcan orange, Watchung Red, permanent red, Brilliant Carmine 3B, Brilliant Carmine 6B, Dupont Oil Red, Pyrazolone Red, Lithol Red, Rhodamine B Lake, Lake Red C, Rose Bengale, aniline blue, or ultramarine blue, chalco oil blue, methylene blue chloride, phthalocyanine blue, phthalocyanine green, or malachite green oxalate, as well as various dyes such as acridine based, xanthene based, azo based, benzoquinone based, azine based, anthraquinone based, dioxazine based, thiazine based, azomethine based, indigo based, thioindigo based, phthalocyanine based, aniline black based, polymethine based, triphenylmethane based, diphenylmethane based, or xanthene based. These colorants may be employed individually or in combinations of at least two types.

The average diameter of the above colorants is commonly in the range of at most 1 μm, preferably in the range of at most 0.5 μm, but is more preferably in the range of 0.01-0.5 μm. By controlling the average particle diameter of colorant particles to be at most 1 μm, since it is possible to narrow the finally resulting particle size distribution and to minimize the formation of liberated particles, performance and reliability of the toner are enhanced. Further, by controlling the average particle diameter within the above range, deviation among toner particles is decreased to improve dispersibility of toner particles incorporated with various components, whereby fluctuations of performance and reliability of the toner are advantageously reduced. Further, when the average diameter is at most 0.5 μm, advantages are exhibited in which toner particles exhibit excellent color forming properties, color reproduction, and OHP transmission properties. Incidentally, the above average particle diameter is a mean volume diameter (D4) measured by MICROTRAC UPA (made by HONEYWELL).

When toner is produced by the manufacturing process 2, the average particle diameter of the above release agent particles is preferably at most 1 μm, but is more preferably in the range of 0.01-1 μm. By controlling the average particle damager to be at most 1 μm, it is possible to narrow the particle size distribution of the finally produced toner particles and to minimize the generation of liberated particles, whereby performance and reliability of the toner are enhanced. Further, by controlling the average particle diameter within the aforesaid range, non-uniform presence of the release agents among toner particles is minimized and the dispersibility of release agents in toner particles is improved. As a result, advantageously, fluctuation of the performance and reliability of the toner are minimized. Incidentally, the above average particle diameter is a mean volume diameter (D4) measured by MICROTRAC UPA (made by HONEYWELL).

Incidentally, these releasing agents are dispersed together with ionic surface active agents, polymer acids, and polymer electrolytes such as polymer bases in a water based medium such as water, and heated to the temperature higher than the melting point and processed employing a homogenizer or a pressure ejection type homogenizer under an application of a weak sharing force, whereby it is possible to easily prepare minute particles of a diameter of at most 1 μm. When making a releasing agent contain beforehand in resin particles in the manufacturing process 1, a solution which contains a releasing agent and a vinyl linked with monomer is used, the solution is heated in a water base media together with a surfactant more than the melting point of the releasing agent, and then processed by a homogenizer or a pressure discharge type dispersing machine (for example, CLEAMIX) which can impress a strong sharing force, so as to disperse them into droplets of about 0.01-0.5 micrometer. Then, they are polymerized by supplying radical with a polymerizing starter in a water base media, thereby producing resin particles containing the releasing agent.

When the toner is produced, there is no particular limitation except that in the combination of minute resinous particles, colorants, and release agent, the release agents of a melting point of 40-75° C. are employed, and it is possible to freely select and then use those in response to the purposes.

The average particle diameter of the aforesaid other components employed in the production method of the toner is preferably at most 1 μm, but is more preferably in the range of 0.01-1 μm. By controlling the average particle diameter to at most 1 μm, it is possible to narrow the particle size distribution of the finished toner, whereby the performance and reliability of the toner are enhanced due to minimization of the formation of liberated particles. Further, deviation among toner particles is decreased and the dispersibility of components in toner particles is improved. As a result, fluctuations of performance and reliability of the toner are advantageously minimized. Incidentally, the above average particle diameter is a mean volume diameter (D4) measured by MICROTRAC UPA (made by HONEYWELL).

The formulation of a toner composition containing the resins, colorants, and release agents is as follows. The content of the colorants is at most 50 percent by weight, but is preferably in the range of 2-40 percent by weight, and the content of the release agents is also at most 50 percent by weight, but is preferably in the range of 2-40 percent by weight. Further, the content of other components is not particularly limited as long as the purposes of the present invention are adversely affected. The content of the other components is commonly very small, is specifically 0.01-5 percent by weight, but is preferably in the range of 0.5-2 percent by weight.

Employed as dispersion media of minute resinous particle dispersion, colorant dispersion, release agent dispersion, and other component dispersion in the production method of the toner may, for example, be water-based media. Examples of water based media include water such as distilled water or ion-exchanged water as well alcohols. These may be used individually or in combinations of at least two types.

In the above dispersion, it is preferable that surface active agents are added to the water based media and then mixed. In the production method of the toner, at least the above minute resinous particle desertion and the above colorant dispersion are mixed to form coagulation particles. Even in the case in which the above release agent dispersion is added to the resulting coagulation particles and the above release agent particles are allowed to adhere onto the surface vicinity of the aforesaid coagulation particle, the addition of surface active agents is advantageous to improve the stability of dispersion panicles such as aforesaid minute resinous particles, colorant particles, or release agent particles in water-based media, and further to enhance of the storage stability of the dispersion. Further, it is advantageous in terms of stability of the above coagulation particles in the coagulation process.

Listed as surface active agents are, for example, anionic surface active agents such as those which are sulfuric acid ester salt based, sulfonic acid salt based, phosphoric acid ester based, and soap based; cationic surface active agents such as those which are an amine salt type and a quaternary ammonium salt type; and nonionic surface active agents such as those which are polyethylene glycol based, alkylphenol ethylene oxide addition product based, and polyhydric alcohol based. Of these, preferred are ionic surface active agents and more preferred are anionic and cationic surface active agents.

Surface active agents employable in the aforesaid dispersion, even though their polarity is the same, cause no problem. However, when the polarity of surface active agents incorporated in the aforesaid resinous particle dispersion and the aforesaid colorant particle dispersion is different from that of surface active agents incorporated in the aforesaid release agent dispersion, it is possible to decrease liberation of the release agents. Further, advantageously, it is also possible to decrease liberation of other particles in the following adhesion process.

Generally, anionic surface active agents exhibit a relatively strong dispersion force and result in excellent dispersion of minute resinous particles as well as colorants. Further, in order to disperse release agents, cationic surface active agents are superior to others. Incidentally, it is preferable that nonionic surface active agents are employed together with the above anionic surface active agents or cationic surface active agents. Surface active agents may be employed individually or in combinations of at least two types.

Specific examples of anionic surface active agents include fatty acid soaps such as potassium laurate, sodium oleate, sodium castor oil; sulfuric acid esters such as octyl sulfate, lauryl sulfate, lauryl ether sulfate, or nonyl phenyl ether sulfate; sodium alkylnaphthalenesulfonates such as lauryl sulfonate, dodecybenznesulfoante, triisopropylnaphthalenesulfonte, or dibutylnaphthalenesulfonate; sulfonic acid salts such as naphthalenesulfonate formalin condensation products, monooctylsulfosuccinate, dioctylsulfosuccinate, lauric acid amidosulfonate, or oleic acid amidosulfonate; phosphoric acid esters such as lauryl phosphate, isopropyl phosphate, nonyl phenyl ether phosphate; dialkylsulfosuccinic acid salts such as sodium dioctylsulfosuccinate; sulfosuccinic acid salts such as disodium lauryl sulfosuccinate.

Specific examples of cationic surface active agents include amine salts such as a laurylamine hydrochloric acid salts, stearyl amine hydrochloric acid salts, oleylamine acetic acid salts, stearylamine acetic acid salts, or stearylaminopropylamine acetic acid salts and quaternary ammonium salts such as lauryltrimethylammonium chloride, dilauryldimethylammonium chloride, disearylammonium chloride, or distearyldimerthylammonium chloride, lauryldihydroxyethylammonium chloride, oleylbispolyoxyethylene methylammonium chloride, laurylaminopropyldimethylethylmmonium sulfate, lauroylaminopropyldimethylhydroxyethylammonium perchlorate, alkylbenznedimethylammonium chloride, alkyltrimethylammonium chloride.

Specific examples of nonionic surface active agents include alkyl ethers such as polyoxyethylene octyl ether, polyoxyethylene lauryl ether, polyoxyethylene stearyl ether, or polyoxyethylene oleyl ether; alkylphenyl ethers such as polyoxyethylene octyl phenyl ether or polyoxyethylene nonyl phenyl ether; alkyl esters such as polyoxyethylene laurate, polyoxyethylene stearate, or polyoxyethylene oleate; alkylamines such as polyoxyethylene lauryl aminoether, polyoxyethylene stearyl aminoether, polyoxyethylene oleyl aminoether, polyoxyethylene soy bean aminoether, or polyoxyethylene tallow aminoether; alkylamides such as polyoxyethylene lauric acid amide, polyoxyethylene stearic acid amide, or polyoxyethylene oleic acid amide; vegetable oil ethers; such as polyoxyethylene castor oil ether or polyoxyethylene rapeseed oil ether; alkanolamides such as lauric acid diethanolamide, stearic acid diethanolamide, or oleic acid diethanolamide; sorbitan ester ethers such as polyoxyethylenesorbitan monolaurate, polyoxyethylene sorbitan monopalmeate, polyoxyethylene sorbitan monostearate, or polyoxyethylene sorbitan monooleate.

The content of surface active agents in each dispersion may be in the amount which does not adversely affect the production of the toner, and is generally in a small amount. The specific amount is commonly in the range of 0.01-10 percent by weight, is preferably in the range of 0.05-5 percent by weight, but is more preferably in the range of 0.1-2 percent by weight. By controlling the content to be in the range of 0.01-10 percent by weight, it is possible to desirably maintain the dispersibility of colorant dispersions as well as release agent dispersions, whereby dispersion materials are not subjected to coagulation in each dispersion. Further, even though the stability of each of the particles during the coagulation process may be in a different state, it is possible to perform secured coagulation without liberation of specified particles. Further, by controlling the content within the above range, it has been confirmed that it is possible to narrow the particle size distribution of particles and it is easily control the particle diameter.

Preparation methods of minute resinous particle dispersion are not particularly limited, and it is possible to suitably select a desired method in response to the purpose. For example, its preparation is performed as follows. In the case in which resins in a resinous particle dispersion are homopolymers or copolymers (vinyl based resins) of esters having a vinyl group, vinyl nitriles, vinyl ethers, and vinyl ketones, vinyl based monomers undergo emulsion polymerization or seed polymerization in ionic surface active agents to form minute resinous particles and the resulting resinous particles are dispersed into ionic surface active agents, whereby a minute resinous particle dispersion is prepared.

In the case in which resins in a resinous particle dispersion are those other than homopolymers or copolymers of vinyl monomers, usable resins may be those which exhibit relatively low solubility in water and are soluble in oil solvents. Resins dissolved material which is prepared by dissolving resins in oil solvents is added to water together with ionic surface active agents and polymer electrolytes and the resulting mixture is dispersed employing a homogenizer. Thereafter preparation is finished by evaporation oil solvents by heating and/or pressure reduction.

It is possible to prepare a colorant dispersion by dispersing colorants into a water based medium containing surface active agents. A release agent dispersion is prepared as follows. The release agents are dispersed into water together with ionic surface active agents, polymer acids, and polymer electrolytes such as polymer bases, and while heating to the temperature higher than the melting point, release agents are subjected to formation of minute particles under application of a strong shearing force, employing a homogenizer or a pressure ejection type homogenizer. The dispersion of other components (particles) is prepared by dispersing those into a water based medium containing surface active agents in the same manner as for the colorant dispersion.

Dispersing methods are not particularly limited. For example, listed are prior art homogenizers such as a rotation shearing type homogenizer, a ball mill having media, a sand mill, and a dyno mill.

In the process which prepares a coagulation particle dispersion in the case employing an emulsion polymerization coagulation method, it is preferable to use, as a coagulant, compounds having a univalent or higher valent charge. Listed as such compounds are water-soluble surface active agents such as nonionic surface active agents, acids such as hydrochloric acid, sulfuric acid, nitric acid, acetic acid, or oxalic acid, metal salts such as magnesium chloride, ammonium sulfate, aluminum nitrate, metal salts of inorganic acids such as silver nitrate, copper sulfate, sodium carbonate; metal salts of aliphatic or aromatic acids; metal salts of phenols such as sodium phenolate; metal salts of amino acids; inorganic acid salts of aliphatic or aromatic amines such as triethanolamine hydrochloric acid salts, or aniline hydrochloric acid salt. Of these, metal salts of inorganic acids are preferred since they exhibit desired performance of the toner such as stability of coagulation particles, and thermal stability and storage stability of coagulants and advantages for the use.

The added amount of these coagulants varies depending on the valence number of the charge but is in the range of a small amount for any valence. It is preferable that in the case of univalence, the added amount is at most three percent by weight, in the case of divalence, is at most one percent by weight, and in the case of trivalence or higher, is at most 0.5 percent by weight. Since a less amount of coagulants is preferred, compounds having higher valence are preferably employed.

Minute inorganic particles composed silica, alumina, titania, or calcium carbonate and resinous particles composed of vinyl based resins, polyester resins, or silicone resins may be added onto the surface of the toner in a dry state, employing a shearing force. These inorganic particles as well as resinous particles function as external additives such as a fluidity aid or a cleaning aid.

The molecular weight distribution of resins employed in the toner, namely the ratio (Mw/Mn) of weight average molecular weight (Mw) to number average molecular weight (Mn), determined by gel permeation chromatography is commonly in the range of 4-30, is preferably in the range of 4-20, but is more preferably in the range of 5-15.

When the molecular weight distribution (Mw/Mn) is controlled to the range of 4-30, the transparency, smoothness, and color mixture properties of fixed images are sufficiently exhibited. Specifically, in the case in which toner images are formed on film sheets for the use of OHP, light is sufficiently transmitted, whereby projected images become clear and bright, and further exhibit desired color reproduction. Further, since the decrease in viscosity of the toner during fixing at high temperatures, no off-setting results. As noted above, when the molecular weight distribution (Mw/Mn) is within the range of the above numeric values, the transparency, smoothness and color mixture properties of fixed images result as desired, and the decrease in viscosity of electrostatic image developing toner during fixing at high temperatures is minimized, whereby it is possible to effectively control the generation of off-setting.

The toner employed in the present invention exhibits excellent characteristics such as chargeability, developability, fixability, or cleaning properties, and particularly, the resulting images exhibit excellent smoothness, transparency, color mixture properties and color forming properties. Further, the above toner is not affected by ambient conditions and consistently exhibits and maintains the above characteristics whereby high reliability is obtained. Further, the toner is produced employing the emulsion polymerization coagulation method. As a result, being different from the case in which production is performed employing a kneading pulverization method, it is possible to decrease the average particle diameter and narrow the particle size distribution.

The charge amount of the toner is commonly 10-40 μC/g, but is preferably 15-35 μC/g. By controlling the charge amount of the toner within 10-40 μC/g, it is possible to produce toner images of desired density while minimizing the generation of background stain. The ratio of the charge amount of the toner during summer (30° C. and 85 percent relative humidity) to the same during winter (10° C. and 30 percent relative humidity) is commonly in the range of 0.5-1.5, but is preferably in the range of 0.7-1.3. By maintaining the above ratio, the toner is not affected by ambience, and it is possible to maintain the desired charge amount. As a result, it is possible to consistently produce excellent toner images for the practical use.

In the image forming method, toner may be employed in a single component developing agent in which the toner is employed individually or may be in a double component developing agent in which the toner is combined with carriers. The above carriers are not particularly limited and prior art resins coated carriers are employed which are described in JP-A Nos. 62-39879 and 56-11461.

EXAMPLE

Hereinafter, description will be made in detail with reference to embodiments, but it should be understood that the present invention is not to be construed as being limited thereto.

<<Production of Toners>>

1. Production of Toners by Process 1 (Preparation of Resin Particles (1 HML))

(1) Preparation of Core Particles (First Stage Polymerization)

In a separable flask equipped with a mixer, a temperature sensor, a cooling tube, and nitrogen introduction equipment, 7.08 g of an anionic surface active agent indicated by the following formula was dissolved in 3010 g of ion-exchange water to produce a surface active agent solution (water system medium), and then the temperature within the flask was raised to 80° C. with stirring at the stirring speed of 230 rpm under a nitrogen gas stream.

Anionic surface active agent; $C_{10}H_{21}(OCH_2CH_2)_2OSO_3Na$ This surface active agent solution was added with an initiator solution in which 9.2 g of a polymerization initiator (potassium persulfate: KPS) was dissolved in 200 g of ion-exchange water. Then, the contents of the flask was raised to a temperature of 75° C., in which the monomer mixture made from 70.1 g of styrene, 19.9 g of n-butylacrylate, and 10.9 g of methacrylic acid was dropped spending one hour. The polymerization (first step polymerization) was carried out by heating and stirring this system for 2 hours at 75° C. to prepare a dispersion of resin particles. This is referred to as the "resin particle dispersion (1H)".

(2) Formation of an Intermediate Layer (Second Step Polymerization)

In a flask equipped with the mixer, a monomer mixture solution made from 105.6 g of styrene, 30.0 g of n-butylacrylate, 6.2 g of methacrylic acid, and 5.6 g of n-octyl-3-mercaptopropionic acid ester, was added with 98.0 g of stearyl stearate (melting point, 58° C.) as the releasing agent, subsequently the contents of the flask was raised to a temperature of 90° C. and dissolved to prepare a monomer solution.

The surface active agent solution in which 1.6 g of the above anionic described anionic surface active agent was dissolved in 2700 g of ion-exchange water was heated to 98° C., and this surface active agent solution was added with 28 g as solid content of the above described "resin particle dispersion (1H)", in which the above described stearyl stearate monomer solution was mixed and dispersed for 8 hours using a mechanical dispersion apparatus having a circulation path, "CLEARMIX" (manufactured by M Technique Co., Ltd.) to prepare a dispersion (an emulsified solution) containing emulsified particles (oil droplets) having a dispersion particle diameter of 284 nm.

Next, this dispersion (emulsified solution) was added with an initiator solution in which 5.1 g of the polymerization initiator (KPS) was dissolved in 240 g of ion-exchange water, and 750 g of ion-exchange water. The polymerization (second step polymerization) was carried out by heating and stirring this system for 12 hours at 98° C. to obtain a dispersion of the resin particles having the structure in which the resin particle surface is covered by a medium molecular weight resin. This is referred to as the "resin particle dispersion (1HM)".

(3) Formation of an Outer Layer (Third Step Polymerization)

The "composite resin particle dispersion (1HM)" obtained as described above was added in which an initiator solution with 7.4 g of the polymerization initiator (KPS) was dissolved in 200 g of ion-exchange water. Under a temperature condition of 80° C., a monomer mixture solution made from 300 g of styrene, 95 g of n-butylacrylate, 15.3 g of methacrylic acid, and 10.4 g of n-octyl-3-mercaptopropionic acid ester was dropped in this system spending one hour. After completing the drop, the polymerization (third step polymerization) was carried out by heating and stirring the resulting system for 2 hours, and then the contents were cooled to 28° C. to obtain a dispersion of the resin particles having the intermediate layer and the outer layer therearound. This is referred to as the "resin particle dispersion (1 HML)".

The particles constituting this "resin particle dispersion (1 HML)" have peak molecular sizes (weights) at 138000, 80000, and 13000. The weight average particle diameter of the resin particles was 122 nm.

Further, resin particle dispersions 2 HML to 6 HML were produced, in the production process of the resin particle dispersion (1 HML), using 99.0 g of myristyl myristate (melting point, 40° C.), 97.0 g of behenyl behenate (melting point, 75° C.), 95.5 g of paraffin wax (melting point, 90° C.), 93.0 g of polyethylene wax (melting point, 98° C.), and 95.5 g of distearyl ketone (melting point, 88° C.) in place of using the stearyl stearate, as the releasing agents respectively.

It has been confirmed that the individual resin particles constituting the obtained resin particle dispersions 2 HML to 6 HML have the same peak molecular weights and weight average particle diameters as those of the resin particles constituting the resin particle dispersion (1 HML).

(Production of Colored Particles)

59.0 g of the above described anionic surface active agent was stirred and dissolved in 1600 g of ion-exchange water, and this solution was gradually added with 420.0 g of a carbon black "REGAL 330" (manufactured by Cabot Co., Ltd.) with stirring, followed by being subjected to dispersion processing using "CLEARMIX" (manufactured by M Technique Co. Ltd.) to prepare a "coloring agent particle dispersion" (hereinafter referred to as the "coloring agent dispersion 1 Bk"). The particle diameters of the coloring agent particles in this coloring agent dispersion were measured using an electrophoretic light scattering photometer "ELS-800" (Otsuka Electronic Co., Ltd.), and the obtained weight average particle diameter was 89 nm.

Next, using the coloring agent dispersion 1 Bk and the resin particle dispersion (1 HML), the resin particles and coloring agent particles were flocculated together with the following procedures. Incidentally, in the present embodiment, the colored particles having the volume-basis median diameters shown in Table 1 were produced respectively. The particle diameter of each of the colored particles was controlled by measuring the particle diameter of the aggregate particle in the process of maturation described below, and by stopping the particle growth when the volume-basis median diameter thereof reached a predetermined diameter.

Placed into a reaction vessel (a four-mouth flask) equipped with a temperature sensor, a cooling tube, nitrogen introduction equipment and a mixer, were 420.7 g (as solid content) of the resin particles (1 HML), 900 g of ion-exchange water, and 166 g of the coloring agent dispersion 1 Bk, and the contents of the vessel were stirred. The temperature within the vessel was adjusted to 30° C., and then 5 mol/L of sodium hydroxide solution was added in the solution whose pH was adjusted to 8 to 10.

Next, with stirring, the resulting solution was added with an aqueous solution in which 12.1 g of magnesium chloride and 6-hydrate was dissolved in 1000 g of ion-exchange water, spending 10 minutes at 30° C. After leaving for 3 minutes, rising temperature was started, and the temperature of the system was raised to 90° C. spending 6 to 60 minutes to carry out the production of aggregate particles (flocculation process). In this state, the particle diameter of the aggregate particle was measured using "COULTER COUNTER TA-II". At the point of time when the volume-basis median diameter reached a predetermined value, the system was added with an aqueous solution in which 40.2 g of sodium chloride was dissolved in 1000 g of ion-exchange water to stop the particle growth, the system was further heated and stirred for 6 hours at the liquid temperature of 98° C., as the process of maturation, to keep continue the fusion of the particles and the phase separation of the releasing agent (process of maturation).

The produced aggregate particles were filtered, repeatedly cleaned with ion-exchange water at 45° C., and then dried with hot air at 40° C. to obtain the colored particles.

The obtained colored particles contain stearyl stearate as the releasing agent, having volume-basis median diameters of 2.3, 3.0, 4.0, 5.0 and 6.0 μm, respectively. Further, obtained from the other resin particle dispersions 2 HML to 6 HML and the coloring agent dispersion 1 Bk were colored particles containing myristyl myristate, behenyl behenate, paraffin wax, polyethylene wax, and distearyl ketone as the releasing agents respectively.

(Addition of Lubricants)

The toners were produced by adding the predetermined amounts of lubricants to the obtained colored particles. The combination of the colored particles, types of lubricants and addition amounts is as shown in Table 1. As described above, the toners 1 Bk to 16 Bk and 26 Bk to 33 Bk (denoted as 1 to 16, 26 to 33 in Table 1) were produced through the process in which the resin particles and coloring agent particles containing the releasing agents were aggregated in the water system medium.

Next, with the same procedures as those described above except that the coloring agent dispersion 1 Bk was replaced with the coloring agent dispersions 1Y, 1M, 1C that were produced in the procedures described below, yellow toners 1Y to 16Y and 26Y to 33Y, magenta toners 1M to 16M and 26M to 33M, and cyan toners 1C to 16C and 26C to 33C were produced. The solid state properties of the produced toners were the same values as the results obtained in 1 Bk to 16 Bk and 26 Bk to 33 Bk respectively.

The coloring agent dispersion 1 Y was produced by gradually adding 420 g of a dye (C. I. solvent yellow 93p) in a solution produced by stirring and dissolving 90 g of the above described anionic surface active agent in 1600 g of ion-exchange water.

The coloring agent dispersion 1M was produced by gradually adding 420 of a dye (C. I. pigment red 122) in a solution produced by stirring and dissolving 90 g of the above describe anionic surface active agent in 1600 g of ion-exchange water.

Further, the coloring agent dispersion 1C was produced by gradually adding 400 g of a dye (C. I. pigment blue 15:3) in a solution produced by stirring and dissolving 90 g of the above described anionic surface active agent in 1600 g of ion-exchange water.

2. Production of Toners by Process 2

(Releasing Agent Particle Dispersion A)

The releasing agent particle dispersion A using stearyl stearate was produced by mixing 68.33 parts of demineralized water, 30 parts of stearyl stearate (melting point, 58° C.), and 1.67 parts of sodium dodecilbenzensulfonate (Neogen SC manufactured by Daiichi Kogyo Seiyaku Co., Ltd, active ingredient of 66%), and the mixture was subjected to high pressure shearing and thereby emulsified to produce the releasing agent particle dispersion A using stearyl stearate. The average particle diameter of the releasing agent particles measured by ELS-800 was 350 nm.

(Releasing Agent Particle Dispersion B)

The releasing agent particle dispersion B was produced with the same procedures as those in the releasing agent particle dispersion A expect for using 32 parts of myristyl myristate (melting point, 40° C.) in place of the stearyl stearate used for the releasing agent particle dispersion A. The average particle diameter of the releasing agent particles measured by ELS-800 was 355 nm.

(Releasing Agent Particle Dispersion C)

The releasing agent particle dispersion C was produced with the same procedures as those in the releasing agent particle dispersion A expect for using 29 parts of behenyl behenate (melting point, 75° C.) in place of the stearyl stearate used for the releasing agent particle dispersion A. The average particle diameter of the releasing agent particles measured by ELS-800 was 350 nm.

(Releasing Agent Particle Dispersion D)

The releasing agent particle dispersion D was produced with the same procedures as those in the releasing agent particle dispersion A expect for using 30 parts of distearyl ketone (melting point, 88° C.) in place of the stearyl stearate used for the releasing agent particle dispersion A. The average particle diameter of the releasing agent particles measured by ELS-800 was 345 nm.

(Releasing Agent Particle Dispersion E)

The releasing agent particle dispersion E was produced with the same procedures as those in the releasing agent particle dispersion A expect for using 33 parts of paraffin wax (melting point, 97° C.) in place of the stearyl stearate used for the releasing agent particle dispersion A. The average particle diameter of the releasing agent particles measured by ELS-800 was 365 nm.

(Releasing Agent Particle Dispersion F)

The releasing agent particle dispersion F was produced with the same procedures as those in the releasing agent particle dispersion A expect for using 28 parts of polyethylene wax (melting point of 98° C.) in place of the stearyl stearate used for the releasing agent particle dispersion A. The average particle diameter of the releasing agent particles measured by ELS-800 was 355 nm.

(Polymer Primary Particle Dispersion A)

Placed into a reaction vessel (an inner volume of 2 litters, an inner diameter of 120 mm) equipped with a mixer (full-zone wing), heating and cooling equipment, concentration equipment, material placing equipment and auxiliary agent placing equipment were 35 parts of the releasing agent particle dispersion A and 397 parts of demineralized water, and the contents of the vessel was raised to a temperature of 90° C. under a nitrogen gas stream, in which 1.6 parts of 8% hydrogen peroxide solution and 1.6 parts of 8% ascorbic acid solution were added. Subsequently, the resulting system was added with a mixture of the following monomers and emulsifying agent solution spending 5 hours from the start of the polymerization, and also added with the initiator solutions spending 6 hours from the start of the polymerization, and then was kept for further 30 minutes.

| | |
|---|---|
| (Monomers) | |
| Styrene: | 9 parts (237 g) |
| Butylacrylate: | 21 parts |
| Acrylic acid: | 3 parts |

-continued

| | |
|---|---|
| Octanethiol: | 0.38 parts |
| 2-mercaptoethanol: | 0.01 parts |
| Hexanedioldiacrylate: | 0.9 parts |
| (Emulsifying solution) | |
| 15% Neogen SC solution: | 1 part |
| Demineralized water: | 25 parts |
| (Initiator solutions) | |
| 8% hydrogen peroxide solution: | 9 parts |
| 8% ascorbic acid solution: | 9 parts |

After polymerization reaction, the resulting solution was cooled to obtain a milky white polymer primary particle dispersion A. The tetrahydrofuran-insoluble component of the polymer was 53% by mass, the weight average particle diameter of the tetrahydrofuran-soluble component thereof was 139000, and the average particle diameter thereof measured by ELS-800 was 201 nm.

(Polymer Primary Particle Dispersions B to F)

The polymer primary particle dispersions B to F were produced with the same procedures as those in the polymer primary particle dispersion A except for using the releasing agents B to F in place of the releasing agent particle dispersion A used for the polymer primary particle dispersion A. The tetrahydrofuran-insoluble component of each of the produced polymers, the weight average particle diameter of tetrahydrofuran-soluble component thereof, and average particle diameter thereof measured by ELS-800 were the same values as those of the polymer primary particle dispersion A.

(Resin Fine Particle Dispersion A)

Placed into a reaction vessel (an inner volume of 2 litters, an inner diameter of 120 mm) equipped with a mixer (three sweepback wings), heating and cooling equipment, concentration equipment, material placing equipment and auxiliary agent placing equipment were 6 parts of 15% Neogen SC solution and 372 parts of demineralized water, and the contents of the vessel was raised to a temperature of 90° C. under a nitrogen gas stream, in which 1.6 parts of 8% hydrogen peroxide solution and 1.6 parts of 8% ascorbic acid solution were added. Subsequently, the resulting system was added with a mixture of the following monomers and emulsifying agent solution spending 5 hours from the start of the polymerization, and also added with the initiator solutions spending 6 hours from the start of the polymerization, and then was kept for further 30 minutes.

| | |
|---|---|
| (Monomers) | |
| Styrene: | 88 parts (308 g) |
| Butylacrylate: | 12 parts |
| Acrylic acid: | 2 parts |
| Bromotrichloromethane: | 0.5 parts |
| 2-mercaptoethanol: | 0.01 parts |
| Hexanedioldiacrylate: | 0.4 parts |
| (Emulsifying solution) | |
| 15% Neogen SC solution: | 3 parts |
| Demineralized water: | 23 parts |
| (Initiator solutions) | |
| 8% hydrogen peroxide solution: | 9 parts |
| 8% ascorbic acid solution: | 9 parts |

After polymerization reaction, the resulting solution was cooled to obtain a milky white resin fine particle dispersion A.

The tetrahydrofuran-insoluble component of the polymer was 10% by mass, the weight average particle diameter of the tetrahydrofuran-soluble component thereof was 57000, and the average particle diameter thereof measured by ELS-800 was 56 nm.

(Coloring Agent Particle Dispersion Bk)

The water dispersion (35% as solid content) of a carbon black (product name; REGAL 330R, manufactured by Cabot Co., Ltd.). The average particle diameter measured by ELS-800 was 150 nm.

(Coloring Agent Particle Dispersions Y, M, C)

The water dispersion produced using C. I. pigment yellow 180 as the colorant, in place of the carbon black used for the above coloring agent particle dispersion A, was referred to as the coloring agent particle dispersion. Y. The water dispersion produced using C. I. pigment red 122 as the colorant was referred to as the coloring agent fine particle dispersion M. Further, the water dispersion produced using C. I. pigment blue 15:3 as the colorant was referred to as the coloring agent particle dispersion C. The solid contents of the coloring agent particle dispersions were all 35%, and the average particle diameters measured by ELS-800 were all 150 nm.

(Production of Colored Particles)

Polymer primary particle dispersion A: 105 parts (71 g as solid content).

Resin fine particle dispersion A: 5 parts (as solid content)

Coloring agent fine particle dispersion Bk: 6.7 parts. (as solid content)

Charging control agent fine particle dispersion A: 2 parts (as solid content)

15% Neogen SC solution: 0.5 parts (as solid content)

Using the above components, the colored particles were Produced with the following procedures. Placed into a reaction vessel were the polymer primary particle dispersion A and 15% Neoqen SC solution, and the contents of the vessel were homogeneously mixed, in which the coloring Agent fine particle dispersion Bk was added, and then the resulting dispersion was homogeneously mixed. With stirring, an aluminum sulfate solution (0.53 parts as solid content) was dropped into the obtained mixed dispersion. Subsequently, the contents of the vessel were raised to a temperature of 50° C. spending 25 minutes with stirring and kept for one hour, and then further raised to 63° C. spending 35 minutes and kept for 20 minutes. The resulting system was added with the charging control agent fine particle dispersion A, the rein fine particle dispersion A, and aluminum sulfate solution (0.07 parts as solid content) in this order, and the liquid temperature was raised to 65° C. spending 10 minutes and kept for 30 minutes. The resulting system was added with 15% Neogen SC solution (3 parts as solid content) and the temperature thereof was raised to 96° C. spending 30 minutes, and then kept for 5 hours. Subsequently, the resulting solution was cooled, filtered, rinsed in water and dried to produce colored particles.

The produced colored particles were added with the various lubricants shown in Table 1 in an amount of 1.0% by mass, to produce toners 17 to 25 and 34 to 38 that were produced through the process of aggregating the resin particles and releasing agent particles and coloring agent particles in the water system medium.

Toner produced by the manufacturing process 1 and the manufacturing process 2 are shown in Table 1.

TABLE 1

| | | Releasing agent | | Lubricant | | |
|---|---|---|---|---|---|---|
| Toner No. | *1 | Compositions | Melting point (° C.) | Compositions | Added amount (Mass %) | Volume basis median diameter (μm) |
| Toner 1 | 1 | Stearic acid stearyl | 58 | zinc stearate | 2.0 | 3.0 |
| Toner 2 | 1 | Stearic acid stearyl | 58 | zinc stearate | 2.0 | 4.0 |
| Toner 3 | 1 | Stearic acid stearyl | 58 | zinc stearate | 2.0 | 5.0 |
| Toner 4 | 1 | Stearic acid stearyl | 58 | zinc stearate | 0.5 | 4.0 |
| Toner 5 | 1 | Stearic acid stearyl | 58 | zinc stearate | 1.0 | 4.0 |
| Toner 6 | 1 | Stearic acid stearyl | 58 | zinc stearate | 4.0 | 4.0 |
| Toner 7 | 1 | Stearic acid stearyl | 58 | zinc stearate | 5.0 | 4.0 |
| Toner 8 | 1 | Stearic acid stearyl | 58 | Aluminium oxide | 3.0 | 5.0 |
| Toner 9 | 1 | Stearic acid stearyl | 58 | calcium myristate | 3.0 | 5.0 |
| Toner 10 | 1 | Stearic acid stearyl | 58 | zinc behenate | 3.0 | 5.0 |
| Toner 11 | 1 | Stearic acid stearyl | 58 | calcium behenate | 3.0 | 5.0 |
| Toner 12 | 1 | Stearic acid stearyl | 58 | calcium laurate | 3.0 | 5.0 |
| Toner 13 | 1 | Myristic acid myristyryl | 40 | Aluminium oxide | 3.0 | 4.0 |
| Toner 14 | 1 | Myristic acid myristyryl | 40 | zinc stearate | 3.0 | 4.0 |
| Toner 15 | 1 | behenyl behenate | 75 | zinc stearate | 3.0 | 4.0 |
| Toner 16 | 1 | behenyl behenate | 75 | behenyl behenate | 3.0 | 4.0 |
| Toner 17 | 2 | Stearic acid stearyl | 58 | zinc stearate | 1.5 | 3.0 |
| Toner 18 | 2 | Stearic acid stearyl | 58 | zinc stearate | 1.5 | 4.0 |
| Toner 19 | 2 | Stearic acid stearyl | 58 | zinc stearate | 1.5 | 5.0 |
| Toner 20 | 2 | Stearic acid stearyl | 58 | Aluminium oxide | 2.0 | 4.0 |
| Toner 21 | 2 | Stearic acid stearyl | 58 | calcium laurate | 2.0 | 4.0 |
| Toner 22 | 2 | Myristic acid myristyryl | 40 | Aluminium oxide | 2.0 | 4.0 |
| Toner 23 | 2 | Myristic acid myristyryl | 40 | calcium behenate | 2.0 | 4.0 |
| Toner 24 | 2 | behenyl behenate | 75 | calcium behenate | 2.0 | 4.0 |
| Toner 25 | 2 | behenyl behenate | 75 | calcium behenate | 2.0 | 4.0 |
| Toner 26 | 1 | Stearic acid stearyl | 58 | zinc stearate | 2.0 | 2.3 |
| Toner 27 | 1 | Stearic acid stearyl | 58 | zinc stearate | 3.0 | 6.0 |
| Toner 28 | 1 | Paraffin wax | 90 | zinc stearate | 3.0 | 5.0 |
| Toner 29 | 1 | Polyethylene wax | 98 | zinc stearate | 3.0 | 5.0 |
| Toner 30 | 1 | distearyl sebacinate | 88 | zinc stearate | 2.5 | 5.0 |
| Toner 31 | 1 | Stearic acid stearyl | 58 | Aluminium oxide | 2.5 | 5.0 |
| Toner 32 | 1 | Myristic acid myristyryl | 40 | Silicon dioxide | 2.5 | 5.0 |
| Toner 33 | 1 | behenyl behenate | 75 | Titanium oxide | 1.5 | 5.0 |

TABLE 1-continued

| Toner No. | *1 | Releasing agent Compositions | Melting point (° C.) | Lubricant Compositions | Added amount (Mass %) | Volume basis median diameter (μm) |
|---|---|---|---|---|---|---|
| Toner 34 | 2 | Stearic acid stearyl | 58 | zinc stearate | 1.5 | 2.3 |
| Toner 35 | 2 | Stearic acid stearyl | 58 | zinc stearate | 1.5 | 6.0 |
| Toner 36 | 2 | Paraffin wax | 90 | zinc stearate | 1.5 | 5.0 |
| Toner 37 | 2 | Polyethylene wax | 98 | zinc stearate | 1.5 | 5.0 |
| Toner 38 | 2 | distearyl sebacinate | 88 | zinc stearate | 1.5 | 5.0 |

*1: Manufacturing process

<<Preparation of Developer>>

Preparation of Carrier

[Preparation of Ferrite Core Material]

In a wet type ball mill, 18 mole-% of MnO, 4 mole-% of MgO and 78 mole-% of Fe2O3 were crushed and mixed for 2 hours and dried. After that, the dried mixture was provisionally baked at 900° C. for 2 hours, and crushed by a ball mill for 3 hours and made to slurry. The slurry was granulated and dried by a spray dryer after the addition of a dispersing agent and a binder, and then the dried granules were subjected to main baking at 1,200° C. for 3 hours. Thus ferrite core material granules having an electro-resistivity of $4.3\times10^{8}$ Ω·cm were obtained.

[Preparation of Coating Resin]

First, by emulsion polymerization method in which concentration in the aqueous solution media using benzenesulfonic acid sodium having alkyl group of a carbon atoms 12 as a surfactant was made into 0.3 weight %, copolymer of cyclo hexyl methacrylate/methyl methacrylate (copolymerization ratios 5/5) was synthesized. The copolymer has a volume average diameter of the primary particles of 0.1 μm, a weight average molecular weight (Mw) of 200,000, a number average molecular weight (Mn) of 91,000, a Mw/Mn ratio of 2.2, a softening point (Tsp) of 230° C. and a glass transition point (Tg) of 110° C. Incidentally, in the emulsification state, the above-mentioned resin fine particles conducted azeotropy to water, and the amount of residual monomers was set to 510 ppm.

Next, into a high speed stirring mixer having stirring wings, 100 parts by weight of the ferrite core granule and 2 parts by weight of the above-described resin fine particle were put and stirred for 30 minutes at 120° C. so as to be obtain resin coated carrier having a volume average particle diameter of 61 μm by utilizing the effects of the mechanical impact.

Preparation of Developer

Each toner particles 1 to 38 were mixed with respective carriers, thereby developer of each color having toner concentration of 6 weight % were prepared respectively. The developers of each color were combined as shown in Table 2 so as to make Developer Sets 1 trough 25 and Comparative Developer Sets 26 through 38. The structure of each developer set is shown in Table 2.

TABLE 2

| Developer set No. | Toner (Developer) Toner No. | Black (Bk) | Yellow (Y) | Magenta (M) | Cyan (C) |
|---|---|---|---|---|---|
| Developer set 1 | Toner 1 | 1Bk | 1Y | 1M | 1C |
| Developer set 2 | Toner 2 | 2Bk | 2Y | 2M | 2C |
| Developer set 3 | Toner 3 | 3Bk | 3Y | 3M | 3C |
| Developer set 4 | Toner 4 | 4Bk | 4Y | 4M | 4C |
| Developer set 5 | Toner 5 | 5Bk | 5Y | 5M | 5C |
| Developer set 6 | Toner 6 | 6Bk | 6Y | 6M | 6C |
| Developer set 7 | Toner 7 | 7Bk | 7Y | 7M | 7C |
| Developer set 8 | Toner 8 | 8Bk | 8Y | 8M | 8C |
| Developer set 9 | Toner 9 | 9Bk | 9Y | 9M | 9C |
| Developer set 10 | Toner 10 | 10Bk | 10Y | 10M | 10C |
| Developer set 11 | Toner 11 | 11Bk | 11Y | 11M | 11C |
| Developer set 12 | Toner 12 | 12Bk | 12Y | 12M | 12C |
| Developer set 13 | Toner 13 | 13Bk | 13Y | 13M | 13C |
| Developer set 14 | Toner 14 | 14Bk | 14Y | 14M | 14C |
| Developer set 15 | Toner 15 | 15Bk | 15Y | 15M | 15C |
| Developer set 16 | Toner 16 | 16Bk | 16Y | 16M | 16C |
| Developer set 17 | Toner 17 | 17Bk | 17Y | 17M | 17C |
| Developer set 18 | Toner 18 | 18Bk | 18Y | 18M | 18C |
| Developer set 19 | Toner 19 | 19Bk | 19Y | 19M | 19C |
| Developer set 20 | Toner 20 | 20Bk | 20Y | 2GM | 20C |
| Developer set 21 | Toner 21 | 21Bk | 21Y | 21M | 21C |
| Developer set 22 | Toner 22 | 22Bk | 22Y | 22M | 22C |
| Developer set 23 | Toner 23 | 23Bk | 23Y | 23M | 23C |
| Developer set 24 | Toner 24 | 24Bk | 24Y | 24M | 24C |
| Developer set 25 | Toner 25 | 25Bk | 25Y | 25M | 25C |
| Comparative developer set 1 | Toner 26 | 26Bk | 26Y | 26M | 26C |
| Comparative developer set 2 | Toner 27 | 27Bk | 27Y | 27M | 37C |
| Comparative developer set 3 | Toner 28 | 28Bk | 28Y | 28M | 28C |
| Comparative developer set 4 | Toner 29 | 29Bk | 29Y | 29M | 29C |
| Comparative developer set 5 | Toner 30 | 30Bk | 30Y | 30M | 30C |
| Comparative developer set 6 | Toner 31 | 31Bk | 31Y | 31M | 31C |
| Comparative developer set 7 | Toner 32 | 32Bk | 32Y | 32M | 32C |
| Comparative developer set 8 | Toner 33 | 33Bk | 33Y | 33M | 33C |
| Comparative developer set 9 | Toner 34 | 34Bk | 34Y | 34M | 34C |
| Comparative developer set 10 | Toner 35 | 35Bk | 35Y | 35M | 35C |
| Comparative developer set 11 | Toner 36 | 36Bk | 36Y | 36M | 36C |
| Comparative developer set 12 | Toner 37 | 37Bk | 37Y | 37M | 37C |
| Comparative developer set 13 | Toner 38 | 38Bk | 38Y | 38M | 38C |

Evaluation Test

Image forming experiments were carried out employing the above-described developers and the full color image forming apparatus shown in FIG. 1. The ultrasonic waves to be applied to the photoreceptor and the image receiving material during the transferring step was generated by the following conditions.

Conditions of the Ultrasonic Wave Generating Apparatus

Distance L2 between the ultrasonic waves irradiating face to the face facing to the irradiating face: 4.25 mm Ultrasonic generating element has:

Resonance frequency: 40 kHz

Output electric power: 5 W

The fixing was carried out by the method employing the heating roller set at 165° C. and at a line speed of 420 mm/sec.

Under the above conditions, 100,000 sheets of image formation were carried out.

The same evaluations were performed about image formation under a low temperature and low humidity condition at 10° C. and 20% RH, referred to as LL, and a high temperature and high humidity condition at 30° C. and 85% RH, referred to as HH; the fluctuation of the image formation is considerably expanded under such the conditions.

Concrete evaluation items were as follows.

Evaluation of Transfer Ability

<Transfer Efficiency>

The color difference between the first printed image and the 100,000th print image was evaluated as the indicator of the variation of the transfer efficiency due to an influence of supersonic vibration. The color difference was evaluated by the following procedure.

Concretely, the colors of the solid image of secondary colors (red, green and blue) formed on the first and 100,000th images each printed under the both of the conditions were measured by Macbeth Color-eye 7000 and the color difference was calculated by CMC (2:1) color difference equation.

When the color deference calculated by the CMC (2:1) color difference formula is not more than 5, it was judged that the variation of the color of the formed images was within the acceptable range and the good transfer efficient was maintained.

<Image Disturbance>

As evaluation of image disturbance, to evaluate image disturbance under the influence of the oscillation given at the time of a transfer, the resolution (thin line reproducibility) of a line drawing in which each dot was made by toner of four color was evaluated. The line drawing was formed in a form of a straight line in a cross direction to the developing direction of image formation apparatus, the resolution (lines per mm) was evaluated by line discrimination with a 10-time magnifying glass. It was judged by the following ranks.

In the evaluation of the resolution, situation of the occurrence of scattering around the image was evaluated together with. The observation results of the scattering were classified into the following four ranks.

A: No scattering was observed around the image even when the image was observed through the loupe.

B: Although scattering was not observed visually, scattering was observed around the line with a magnifying glass.

C: The scattering around the line was observed.

D: The scattering was considerably occurred so that the lines were indistinguishable.

Fixable Evaluation

<Anti-Offset Ability>

After printing of 100,000 sheets, white paper was printed and the situation of the contamination caused by the offset and that of the surface of the heating roller by the toner were visually evaluated. For the evaluation, thick high quality paper with a weight of 200 g/m$^2$ was employed and a line image having a width of 0.3 mm and a length of 150 mm was formed in the direction the same as the progressing direction of the paper.

A: Both of the offset image on the white paper and the toner contamination on the heating roller were entirely not observed.

B: Though any offset image on the white paper was not confirmed, the toner contamination of the heating roller was observed.

C: The offset image was confirmed on the white paper.

The evaluation ranks A and B was acceptable and rank C was unacceptable for practical use.

<Occurrence of Jamming by Winding>

After printing of 100,000 sheets of image, the line speed was changed from 420 mm/sec to 840 mm/sec while the temperature of the heating roller was maintained at 165° C., and the image formation was performed to evaluate the winding of the paper.

A: Any jamming caused by fault of separation from the fixing roller and any mark of the claw were not observed.

B: Though any jamming by fault of the separation from the fixing roller did not occur, the claw marks were observed some degree (no problem in the practical use).

C: The jamming by winding occurred.

<Filming on the Photoreceptor>

The surface of the photoreceptor was visually observed after printing of 500,000 sheets to judge the presence of the filming.

<Uniformity of Halftone Image>

Degradation of the uniformity of the halftone image accompanied with the variation of the transferring ability caused by the occurrence of the filming was evaluated. The norm of the evaluation was as follows.

A: The image was uniform without unevenness.

B: Although streak-shaped thin unevenness was observed, there was no problem for practical use.

C: Although several streak-shaped thin unevenness were observed, there was no problem for practical use.

D: Presence of 5 or more obvious unevenness lines was confirmed.

The results are shown in Tables 3 and 4.

TABLE 3

| | | Transferring ability | | | | | | | | | | |
|---|---|---|---|---|---|---|---|---|---|---|---|---|
| | | Color | | | Thin line overlapping | | Scattering occurrence | | Fixing ability | | Filming on photoreceptor | |
| | Developer | Dif. | | | | 100000 | | 100000 | | Winding | Filming | |
| | set No. | R | G | B | Initial | sheets | Initial | sheets | *1 | tendency | occurrence | *2 |
| Example 1 | Developer set 1 | 1 | 2 | 1 | A | A | A | A | A | A | No | A |

TABLE 3-continued

| | | Transferring ability | | | | | | | | | | |
|---|---|---|---|---|---|---|---|---|---|---|---|---|
| | | Color | | | Thin line overlapping | | Scattering occurrence | | Fixing ability | | Filming on photoreceptor | |
| | Developer | Dif. | | | | 100000 | | 100000 | | Winding | Filming | |
| | set No. | R | G | B | Initial | sheets | Initial | sheets | *1 | tendency | occurrence | *2 |
| Example 2 | Developer set 2 | 1 | 1 | 1 | A | A | A | A | A | A | No | A |
| Example 3 | Developer set 3 | 1 | 2 | 2 | A | A | A | A | A | B | No | A |
| Example 4 | Developer set4 | 2 | 2 | 1 | A | A | A | A | A | B | No | B |
| Example 5 | Developer set 5 | 1 | 2 | 1 | A | A | A | A | A | A | No | A |
| Example 6 | Developer set 6 | 1 | 1 | 1 | A | A | A | A | A | A | No | A |
| Example 7 | Developer set 7 | 1 | 1 | 2 | A | A | A | A | A | A | No | B |
| Example 8 | Developer set 8 | 3 | 2 | 2 | A | B | A | A | A | A | No | A |
| Example 9 | Developer set 9 | 2 | 3 | 2 | A | B | A | A | A | A | No | A |
| Example 10 | Developer set 10 | 2 | 3 | 2 | A | B | A | A | A | A | No | A |
| Example 11 | Developer set 11 | 1 | 3 | 3 | A | B | A | A | A | A | No | A |
| Example 12 | Developer set 12 | 1 | 2 | 3 | A | B | A | A | A | A | No | A |
| Example 13 | Developer set 13 | 1 | 2 | 1 | A | A | A | A | A | A | No | A |
| Example 14 | Developer set 14 | 1 | 1 | 1 | A | A | A | A | A | A | No | A |
| Example 15 | Developer set 15 | 1 | 1 | 2 | A | A | A | A | A | A | No | A |
| Example 16 | Developer set 16 | 1 | 2 | 2 | A | A | A | A | A | A | No | A |
| Example 17 | Developer set 17 | 1 | 2 | 1 | A | A | A | A | A | A | No | A |
| Example 18 | Developer set 18 | 2 | 2 | 1 | A | A | A | A | A | A | No | A |
| Example 19 | Developer set 19 | 2 | 3 | 1 | A | A | A | B | A | B | No | A |
| Example 20 | Developer set 20 | 3 | 2 | 2 | A | A | A | B | A | B | No | A |
| Example 21 | Developer set 21 | 2 | 1 | 2 | A | A | A | B | A | B | No | A |
| Example 22 | Developer set 22 | 2 | 1 | 1 | A | A | A | A | A | A | No | A |
| Example 23 | Developer set 23 | 1 | 1 | 3 | A | B | A | A | A | A | No | A |
| Example 24 | Developer set 24 | 1 | 1 | 1 | A | A | A | A | A | A | No | A |
| Example 25 | Developer set 25 | 2 | 2 | 3 | A | B | A | A | A | A | No | A |
| Comparative example 1 | Comparative developer set 1 | 5 | 5 | 6 | A | C | A | C | D | C | No | B |
| Comparative example 2 | Comparative developer set 2 | 5 | 6 | 5 | A | A | A | A | A | A | No | B |
| Comparative example 3 | Comparative developer set 3 | 6 | 6 | 7 | A | A | A | A | A | A | Yes | C |
| Comparative example 4 | Comparative developer set 4 | 7 | 6 | 8 | A | A | A | A | A | A | Yes | C |
| Comparative example 5 | Comparative developer set 5 | 7 | 6 | 7 | A | A | A | A | A | A | Yes | C |
| Comparative example 6 | Comparative developer set 6 | 8 | 8 | 7 | A | A | A | B | A | B | Yes | C |
| Comparative example 7 | Comparative developer set 7 | 7 | 8 | 8 | A | A | A | A | A | A | Yes | C |

TABLE 3-continued

| | | Transferring ability | | | | | | | | | | |
|---|---|---|---|---|---|---|---|---|---|---|---|---|
| | | Color | | | Thin line overlapping | | Scattering occurrence | | Fixing ability | | Filming on photoreceptor | |
| | Developer | Dif. | | | | 100000 | | 100000 | | Winding | Filming | |
| | set No. | R | G | B | Initial | sheets | Initial | sheets | *1 | tendency | occurrence | *2 |
| Comparative example 8 | Comparative developer set 8 | 8 | 8 | 8 | A | B | A | A | A | A | Yes | C |
| Comparative example 9 | Comparative developer set 9 | 5 | 6 | 7 | A | A | A | A | A | A | No | B |
| Comparative example 10 | Comparative developer set 10 | 5 | 7 | 6 | A | C | A | C | D | C | No | B |
| Comparative example 11 | Comparative developer set 11 | 8 | 8 | 8 | A | A | A | A | A | A | Yes | C |
| Comparative example 12 | Comparative developer set 12 | 8 | 7 | 8 | A | A | A | A | A | A | Yes | C |
| Comparative example 13 | Comparative developer set 13 | 7 | 8 | 8 | A | A | A | A | A | A | Yes | C |

*1: Offset resistance,
*2: Uniformity of half tone

TABLE 4

| | | Transferring ability | | | | | | | | | | |
|---|---|---|---|---|---|---|---|---|---|---|---|---|
| | | Color | | | Thin line overlapping | | Scattering occurrence | | Fixing ability | | Filming on photoreceptor | |
| | Developer | Dif. | | | | 100000 | | 100000 | | Winding | Filming | |
| | set No. | R | G | B | Initial | sheets | Initial | sheets | *1 | tendency | occurrence | *2 |
| Example 26 | Developer set 1 | 2 | 4 | 3 | A | A | A | A | B | A | No | B |
| Example 27 | Developer set 2 | 3 | 1 | 2 | A | A | A | A | A | A | No | A |
| Example 28 | Developer set 3 | 3 | 2 | 3 | A | B | A | A | A | B | No | B |
| Example 29 | Developer set 4 | 3 | 2 | 4 | A | B | A | B | B | B | No | B |
| Example 30 | Developer set 5 | 2 | 3 | 2 | A | B | A | B | B | A | No | B |
| Example 31 | Developer set 6 | 3 | 1 | 2 | A | A | A | A | A | A | No | A |
| Example 32 | Developer set 7 | 3 | 1 | 2 | A | A | A | A | A | A | No | B |
| Example 33 | Developer set 8 | 3 | 4 | 4 | A | B | A | A | A | A | No | A |
| Example 34 | Developer set 9 | 4 | 3 | 4 | A | B | A | B | B | A | No | B |
| Example 35 | Developer set 10 | 3 | 3 | 3 | A | B | A | A | A | B | No | B |
| Example 36 | Developer set 11 | 2 | 3 | 4 | A | B | A | B | A | B | No | B |
| Example 37 | Developer set 12 | 2 | 3 | 4 | A | B | A | B | B | A | No | B |
| Example 38 | Deve1oper set 13 | 1 | 1 | 3 | A | A | A | A | A | A | No | A |
| Example 39 | Developer set 14 | 1 | 3 | 4 | A | B | A | B | B | A | No | B |
| Example 40 | Developer set 15 | 2 | 1 | 3 | A | A | A | A | A | A | No | A |
| Example 41 | Developer set 16 | 3 | 2 | 2 | A | A | A | B | A | A | No | B |
| Example 42 | Developer set 17 | 2 | 4 | 3 | A | B | A | B | B | A | No | B |
| Example 43 | Developer set 18 | 2 | 2 | 3 | A | A | A | A | A | A | No | A |

TABLE 4-continued

| | Developer | Transferring ability | | | | | | | | | | |
|---|---|---|---|---|---|---|---|---|---|---|---|---|
| | | Color Dif. | | | Thin line overlapping 100000 | | Scattering occurrence 100000 | | | Fixing ability Winding | Filming on photoreceptor Filming | |
| | set No. | R | G | B | Initial | sheets | Initial | sheets | *1 | tendency | occurrence | *2 |
| Example 44 | Developer set 19 | 3 | 4 | 4 | A | B | A | B | A | B | No | B |
| Example 45 | Developer set 20 | 4 | 4 | 3 | A | B | A | B | A | B | No | B |
| Example 46 | Developer set 21 | 3 | 4 | 3 | A | B | A | B | A | B | No | B |
| Example 47 | Developer set 22 | 2 | 2 | 1 | A | A | A | A | A | A | No | A |
| Example 48 | Developer set 23 | 2 | 4 | 4 | A | B | A | B | A | B | No | B |
| Example 49 | Developer set 24 | 2 | 3 | 3 | A | A | A | A | A | A | No | A |
| Example 50 | Developer set 25 | 2 | 3 | 4 | A | B | A | A | B | A | No | B |
| Comparative Example 14 | Comparative developer set 1 | 7 | 7 | 6 | A | D | A | D | X | C | Yes | C |
| Comparative Example 15 | Comparative developer set 2 | 6 | 7 | 5 | A | D | A | D | X | C | Yes | C |
| Comparative Example 16 | Comparative developer set 3 | 8 | 9 | 7 | B | D | B | D | X | D | Yes | D |
| Comparative Example 17 | Comparative developer set 4 | 9 | 7 | 8 | B | D | B | D | D | D | Yes | D |
| Comparative Example 18 | Comparative developer set 5 | 8 | 9 | 7 | B | D | B | D | D | D | Yes | D |
| Comparative Example 19 | Comparative developer set 6 | 9 | 8 | 9 | C | D | C | D | D | D | Yes | D |
| Comparative Example 20 | Comparative developer set 7 | 8 | 9 | 9 | C | D | C | D | D | D | Yes | D |
| Comparative Example 21 | Comparative developer set 8 | 9 | 8 | 9 | C | D | C | D | D | D | Yes | D |
| Comparative Example 22 | Comparative developer set 9 | 6 | 6 | 7 | A | D | A | D | D | C | Yes | C |
| Comparative Example 23 | Comparative developer set 10 | 6 | 7 | 7 | A | D | A | D | D | C | Yes | C |
| Comparative Example 24 | Comparative developer set 11 | 9 | 8 | 9 | C | D | C | D | D | D | Yes | D |
| Comparative Example 25 | Comparative developer set 12 | 9 | 7 | 8 | C | D | C | D | D | D | Yes | D |
| Comparative Example 26 | Comparative developer set 13 | 9 | 8 | 9 | C | D | C | D | D | D | Yes | D |

*1: Offset resistance,
*2: Uniformity of half tone

As can be seen from Tables 3 to 4, it was confirmed that the image forming method of the present invention shows excellent transfer performance and fixing performance, and filming performance to a photoreceptor.

Namely, even if image formation having an ultrasonic transfer process is conducted under relentless circumstances such as under low temperature and low humidity circumstances or high temperature and high humidity circumstances, it is confirmed that a release agent does not detach from toner under the influence of supersonic vibration and an image with high quality and beautiful full color can be formed stably.

Further, when evaluation was conducted by using a full color image forming apparatus shown FIG. 3 with the transferring condition and the fixing condition and the evaluation item same with those in the above evaluation test, a result almost same with that indicated in Tables 3 and 4 was obtained.

In this manner, according to the present invention, it was confirmed that a high quality full color image can be formed stably with an image forming apparatus having a transferring process to conduct transferring with a ultrasonic wave.

What is claimed is:

1. An image forming method, comprising:

a step of forming a toner image on an image carrying member with a toner; and a step of transferring the toner image from the image carrying member to a transfer member applying ultrasonic vibration, wherein the toner has a volume-basis median diameter of 3.0 to 5.0 μm, contains a releasing agent with a melting point in the range of from 40° C. to 75° C., and is added with a lubricant, the lubricant being a high fatty acid metal salt having a carbon number of 12 or more.

2. The image forming method of claim 1, wherein the higher fatty acid metal salt has a water content of 0.1 to 2.5% by mass and contains 0.01 to 0.7% by mass of a free fatty acid.

3. The image forming method of claim 1, wherein when the sum of the toner and the lubricant is 100% by mass, the lubricant has an added amount of 0.3% by mass to 10% by mass.

4. The image forming method of claim 1, wherein the toner has a volume basis median diameter of 3.5 μm to 4.5 μm.

5. The image forming method of claim 1, wherein the releasing agent has an added amount of 0.5 to 50% by mass to the toner.

6. The image forming method of claim 5, wherein the releasing agent has an added amount of 1 to 30% by mass to the toner.

7. The image forming method of claim 6, wherein the releasing agent has an added amount of 5 to 15% by mass to the toner.

8. The image forming method of claim 1, wherein the toner is produced through a process of coagulating resin particles containing a releasing agent and coloring particles in water base media.

9. The image forming method of claim 1, wherein the toner is produced through a process of coagulating resin particles, a releasing agent and coloring particles in water base media.

10. The image forming method of claim 1, wherein the toner is formed on a photoreceptor as the image carrying member and is transferred to an intermediate transfer belt as the transfer member.

11. The image forming method of claim 1, wherein the toner is formed on an intermediate transfer belt as the image carrying member and is transferred to a transfer sheet as the transfer member.

* * * * *